US008785796B2

(12) United States Patent
Bronstein et al.

(10) Patent No.: US 8,785,796 B2
(45) **Date of Patent: *Jul. 22, 2014**

(54) SYSTEM AND METHODS FOR ELECTRONIC DEVICE KEYBOARD ILLUMINATION

(71) Applicant: Apple Inc., Cupertino, CA (US)

(72) Inventors: Chad A. Bronstein, Sunnyvale, CA (US); Peter H. Mahowald, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 89 days.

This patent is subject to a terminal disclaimer.

(21) Appl. No.: 13/678,130

(22) Filed: Nov. 15, 2012

(65) Prior Publication Data

US 2013/0069562 A1 Mar. 21, 2013

Related U.S. Application Data

(62) Division of application No. 12/151,363, filed on May 5, 2008, now Pat. No. 8,319,128.

(60) Provisional application No. 61/009,961, filed on Jan. 4, 2008.

(51) Int. Cl.
*H01H 9/00* (2006.01)

(52) U.S. Cl.
USPC ..... 200/314

(58) Field of Classification Search
USPC ..... 200/314
See application file for complete search history.

(56) References Cited

U.S. PATENT DOCUMENTS

| | | | | |
|---|---|---|---|---|
| 5,568,367 | A | 10/1996 | Park | |
| 5,818,361 | A | 10/1998 | Acevedo | |
| 6,987,466 | B1 | 1/2006 | Welch et al. | |
| 7,086,768 | B2 | 8/2006 | Suwa et al. | |
| 7,321,101 | B2 | 1/2008 | Hirobe et al. | |
| 7,503,683 | B2 | 3/2009 | Liu | |
| 7,525,056 | B2 | 4/2009 | Chiba et al. | |
| 8,319,128 | B2 * | 11/2012 | Bronstein et al. | 200/314 |

* cited by examiner

*Primary Examiner* — Renee Luebke
*Assistant Examiner* — Lheiren Mae Caroc
(74) *Attorney, Agent, or Firm* — Van Court & Aldridge LLP

(57) ABSTRACT

A keyboard may be generally illuminated while also providing for key-specific illumination of one or more particular keys. The keyboard may be generally illuminated using any configuration of any number of suitable illumination sources. The keyboard may selectively illuminate any key or keys together with or apart from the general illumination of other keys. The keyboard may also variably illuminate certain keys to aid the user in navigating the keyboard.

27 Claims, 15 Drawing Sheets

SYSTEM AND METHODS FOR ELECTRONIC DEVICE KEYBOARD ILLUMINATION

CROSS-REFERENCE TO RELATED APPLICATION

This application is a divisional of U.S. patent application Ser. No. 12/151,363, filed May 5, 2008 (now U.S. Pat. No. 8,319,128), which claims the benefit of U.S. Provisional Patent Application No. 61/009,961, filed Jan. 4, 2008, both of which are hereby incorporated by reference herein in their entirety.

FIELD OF THE INVENTION

This invention can relate to systems and methods for improved keyboard illumination.

BACKGROUND OF THE DISCLOSURE

Currently, there are a wide variety of known electronic devices that include a keyboard as a user interface component (e.g., cellular telephones and personal computers). The keyboard of many of these devices can be illuminated such that a user may be able to see and use the keyboard when provided with little or no ambient light. For example, some known devices include a light source, such as a light emitting diode ("LED"), underneath each of a plurality of the keys of the keyboard. Alternatively, some known devices include only a few light sources, but diffuse the light in such a way that each of the keys of the keyboard are illuminated.

However, these light sources can add an undesirable additional weight to the electronic device which can undesirably increase the thickness of the electronic devices. Therefore, it would be beneficial to provide systems and methods for improving the illumination of an electronic device keyboard while reducing the thickness and weight.

SUMMARY OF THE DISCLOSURE

Improved systems and methods for electronic device keyboard illumination are provided. In one embodiment, a keyboard includes a plurality of keys and a flexible circuitry layer positioned under the plurality of keys. The flexible circuitry layer includes a plurality of illumination sources for generally illuminating the plurality of keys, wherein each one of the illumination sources is positioned to emit light in the plane of the keyboard, and wherein at least a first one of the illumination sources is positioned to primarily emit light in any direction other than a direction that is directly opposite to the direction of light primarily emitted by each of the other ones of the illumination sources.

In one embodiment, a keyboard includes a plurality of keys and a flexible circuitry layer positioned under the plurality of keys, wherein the flexible circuitry layer includes at least a first illumination source and at least a first source reflective surface, wherein the first illumination source primarily emits light in a first direction, and wherein the first source reflective surface is positioned at a first angle with respect to the flexible circuitry layer to reflect at least a portion of the emitted light in a second direction that is different than the first direction.

In one embodiment, a keyboard includes a plurality of keys and a flexible circuitry layer positioned under the plurality of keys, wherein the flexible circuitry layer includes a plurality of illumination sources, wherein at least a first one of the illumination sources is adapted to illuminate at least one specific portion of the plurality of keys, and wherein at least a second one of the illumination sources is adapted to generally illuminate the plurality of keys.

In one embodiment, a keyboard includes a plurality of keys, a keyboard membrane layer positioned under the plurality of keys, and a transparent layer positioned under the keyboard membrane layer. The keyboard membrane layer includes at least one illumination source configured to primarily emit light into the transparent layer.

In one embodiment, a method for varying the illumination of a keyboard having at least one illumination source includes presenting information with an electronic device, generating an instruction with the electronic device based on the information, transmitting the instruction to the keyboard, and altering the state of the at least one illumination source in response to the keyboard receiving the instruction.

In one embodiment, a system for varying the illumination of a keyboard includes a keyboard having at least one illumination source and a plurality of keys. The system also includes a processing device, wherein the processing device is configured to transmit an instruction, and wherein the keyboard is configured to alter the state of the at least one illumination source in response to receiving the instruction.

BRIEF DESCRIPTION OF THE DRAWINGS

The above and other aspects and advantages of the invention will become more apparent upon consideration of the following detailed description, taken in conjunction with the accompanying drawings, in which like reference characters refer to like parts throughout, and in which.

DETAILED DESCRIPTION OF THE DISCLOSURE

Figure 1:
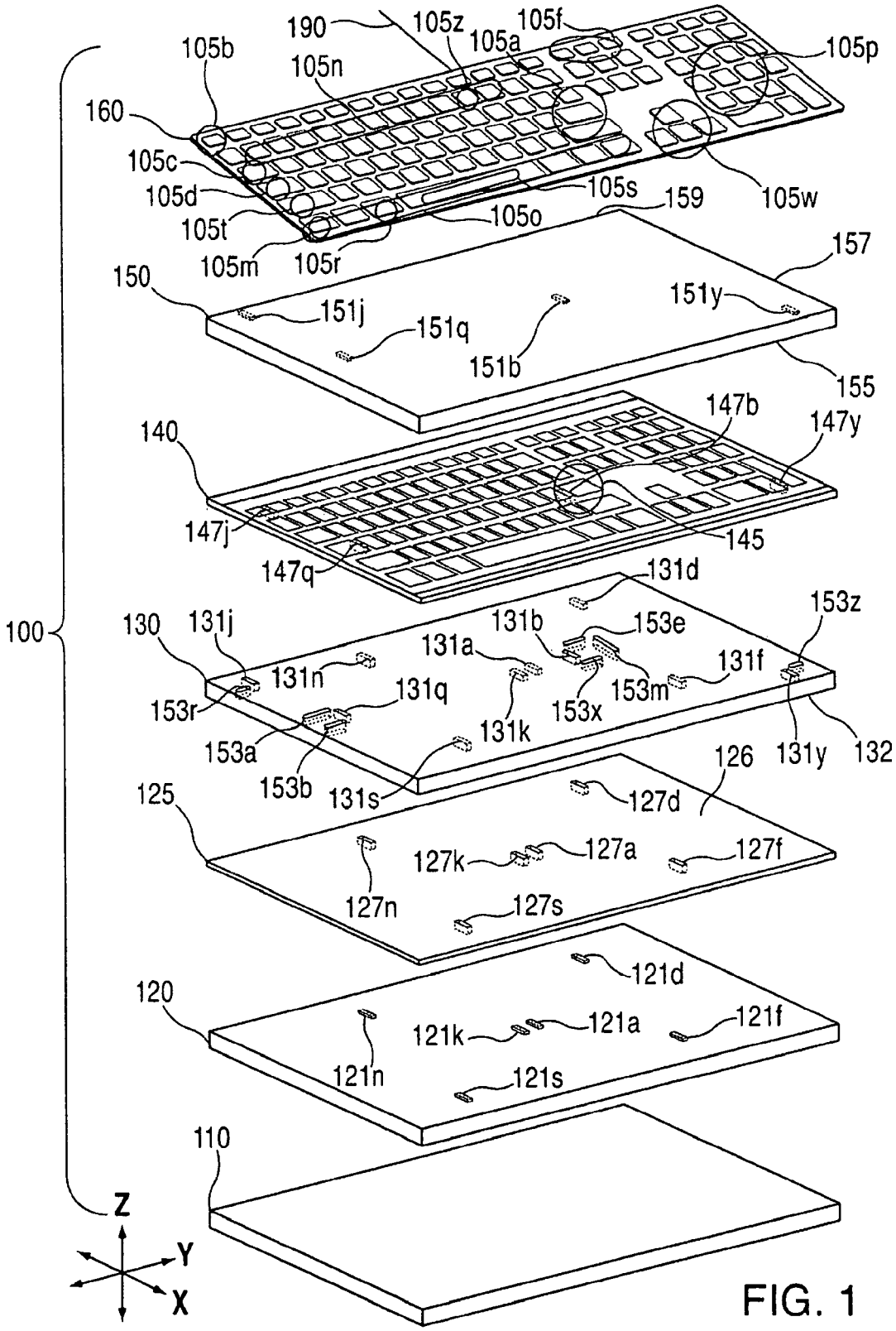
FIG. 1 shows an exploded perspective view of a keyboard assembly in accordance with some embodiments of the invention.

In some embodiments of the invention, general illumination of a keyboard may be provided. The keys of the keyboard assembly may be made of any suitable material, such as plastic, and one or more of the keys may have a transparent legend, a transparent face, or may be entirely transparent. The general illumination may be provided by positioning under the array of keys any number of illumination sources in any suitable arrangement, such that the light emitted by the illumination sources may diffuse under the keys and may illuminate some or all of the keys. Any number of illumination sources, including only one illumination source, may be used, and the angle or angles at which two or more illumination sources are positioned relative to one another may be any suitable size. The illumination sources may be placed anywhere within the keyboard assembly, such as directly underneath the keys on a keyboard membrane, within a light guide pipe, or on a flexible circuit but protruding into a light guide pipe. Each illumination source may be any suitable element able to emit light, such as an LED or an organic LED. In addition to illuminating a keyboard when the device is provided with little or no ambient light, the general illumination of the invention may be provided under any other suitable condition (e.g., when the keyboard is providing instructions to a particular application being run by the electronic device, or when it is determined that the keyboard is being used by a user with a visual disability, for example, in response to a user input).

In some embodiments of the invention, the selective illumination of certain keys of a keyboard assembly may be provided. The selective illumination may occur when any suitable number of illumination sources of the keyboard assembly are instructed to emit light in response to any suitable input, such as an electrical signal received from a computing device coupled to the keyboard assembly, a mechanical input received by the keyboard (e.g., by a keystroke), or any other suitable input. The selective illumination may include placing any suitable number of illumination sources within a keyboard assembly to illuminate one or more particular keys of interest, such as the "CAPS LOCK" key, or the "NUM LOCK" key, or any other suitable key or keys. The one or more illumination sources used to selectively illuminate particular keys may be of the same illumination source type or may even be the one or more illumination sources used to generally illuminate the keyboard. The one or more selective illumination sources may be positioned on or within any suitable layer of the keyboard assembly (e.g., on a keyboard membrane or a flexible circuit but protruding into a light guide pipe). The selective illumination may occur simultaneously with the general illumination of the keyboard. In one embodiment, the keyboard may be generally illuminated with one color while certain keys may be illuminated with one or more other colors. In another embodiment, all of the keys may be constantly illuminated with one color of a certain brightness, while certain keys may be constantly illuminated with the same color but with a greater intensity or in a different manner, such as by blinking. The selective illumination also may occur independently from the general illumination, thereby allowing particular keys on the keyboard to be illuminated at any one time while other keys remain unilluminated.

In some embodiments of the invention, the variable illumination of certain keys of a keyboard assembly may be provided to aid a user in navigating the keyboard. Similarly to the selective illumination, the variable illumination may occur in response to any suitable input, such as an electrical signal received from a computing device coupled to the keyboard assembly, a mechanical input received by the keyboard (e.g., by a keystroke), or any other suitable input. In response to receiving such an input, one or more illumination sources may be instructed to emit light, to stop emitting light, to change color, to blink, or to illuminate one or more keys using any suitable approach. A user may be guided in using the keyboard because the variable illumination of different keys may increase the user's efficiency in navigating the keyboard. In some embodiments, the keyboard may be generally illuminated using one color, while certain keys may be variably illuminated using one or more different colors to guide the user in choosing amongst available menu options. As another alternative, the keyboard may be generally illuminated, and certain keys may be variably illuminated using any other suitable approach (e.g., certain keys that may be useful in choosing amongst available menu options may blink, or certain keys may be more intensely illuminated than other keys illuminated on the keyboard).

In some embodiments of the invention, a user may be presented with a list of menu options on a display screen of an electronic device associated with a keyboard. The electronic device, which may be coupled to the keyboard, may provide electrical inputs to the keyboard. Each electrical input may contain instructions to illuminate certain keys corresponding to the list of available menu options presented on the display screen. In response to such an input, the keyboard may instruct one or more certain illumination sources to emit light such that one or more keys, or all of the keys, may be illuminated to represent available menu options to the user. The inputs from the electronic device may change in real time and the illumination of certain keys may also vary in real time. Certain other keys may not be illuminated, including those that may have been previously variably illuminated, to represent to the user that striking those keys may not result, or may no longer result, in the selection of an available menu option.

In some embodiments of the invention, a user may be presented with a form on a display screen of an electronic device associated with a keyboard, such as an electronic tax form. The variable illumination of one or more different keys on the keyboard may increase the user's efficiency in completing the form using the keyboard. The form may require the user to enter one or more numbers in order to complete the form and may require the user to move or "tab" between entries on the form, or perform mathematical operations with the "+," "–," and "." keys. The electronic device, which may be coupled to the keyboard, may provide a device input to the keyboard instructing that the numerical keys (e.g., the number pad provided on the right side of some keyboards), the "TAB" key, and the "+," "–," and "." keys on the keyboard may be illuminated. In response to such a device input, the keyboard may instruct one or more certain illumination sources to emit light to illuminate these keys such that the user may be guided in completing the form on the display screen. The remainder of the keys on the keyboard may be illuminated in any suitable manner (e.g., the remainder of the keys may be generally illuminated in another color, they may be less intensely illuminated than the keys of interest, or they may not be illuminated at all).

In some embodiments of the invention, different keys of a keyboard assembly may be variably illuminated using any suitable approach to help guide the user of the keyboard through any suitable task. For example, a spelling software program being run by an electronic device associated with the keyboard may instruct the keyboard to variably illuminate those keys needed to properly finish spelling a word once the user has started to type the word. As another example, a variably illuminated keyboard may illuminate the one or more keys that match the first letter of one or more filenames in a directory presented on a display screen associated with the keyboard, thereby guiding a user in selecting from available filenames. As a further example, all of the keys of the keyboard may be variably illuminated in one color associated with a particular application shown on the display screen. If a user minimizes one application associated with a particular color, and maximizes another application instead on the display screen, then the color associated with the second application may be used to illuminate the keys.

It is to be understood that an illumination source may emit light in many directions simultaneously. Reference herein to an illumination source emitting light in a particular direction is to be understood to mean that the illumination source may emit the majority of its light primarily in the referenced direction. A portion of the light emitted by the illumination source may diffuse in directions other than the one referenced herein.

It is also to be understood that the present invention may be employed with any digit-driven user input device. For example, reference herein to a "keyboard" may be understood to include a keyboard coupled to a desktop computer, a keyboard included within a laptop computer or other portable computing device, or any user input interface (e.g., a touch-screen for inputs) for any portable or wired electronic device, such as a pocket-sized personal computer such as an iPAQ Pocket PC available by Hewlett Packard Inc. of Palo Alto, Calif., a personal digital assistant ("PDA"), a personal e-mail or messaging device with audio and/or video capabilities (e.g., a Blackberry® or a Sidekick®), an iPhone™ or an iTouch™ available by Apple Inc., or any other suitable cellular telephone device.

Improved systems and methods for electronic device keyboard illumination are provided and described with reference to FIGS. 1-14.

FIG. 1 shows an exploded perspective view of a keyboard assembly in accordance with some embodiments of the invention. Keyboard assembly 100 may include base layer 110, flex layer 120, reflector sheet layer 125, light guide pipe layer 130, mask layer 140, keyboard membrane layer 150, keypad layer 160, or any other suitable layer. Keyboard assembly 100 may also include one or more illumination sources, reflecting plates, and slots in one or more of its layers. Keyboard assembly 100 may also include one or more flex circuits and voltage sources.

Base layer 110 may at least partially be made of any suitable material for providing structural support to keyboard assembly 100. For example, base layer 110 may be made of a plastic sheet or a metal sheet, such as a piece of aluminum or stainless steel, that may be shiny or dull. Although base layer 110 may be positioned beneath the other layers of keyboard assembly 100, base layer 110 may not be exposed to the user. For example, if keyboard assembly 100 is part of a laptop computer, then base layer 110 may still be contained within the outer casing of the laptop. Base layer 110 may also include any suitable material that may be bent up through an opening in light guide pipe layer 130 to provide an additional reflecting surface to redirect light that may be diffusing through light guide pipe layer 130.

Flex layer 120 may at least partially be made of any suitable material operative to provide support for and/or power to other layers of keyboard assembly 100. Flex layer 120 may be of any suitable thickness and any suitable flexibility. One or more illumination sources may be positioned on flex layer 120, but an illumination source may not need to be positioned on flex layer 120 in order to receive power from flex layer 120. An illumination source may be positioned within light guide pipe layer 130 (described in more detail below), but may still receive power through flex layer 120. Flex layer 120 may also include any suitable logic circuitry to process input signals received by keyboard assembly 100. In some embodiments, flex layer 120 may provide power and support to the illumination sources of keyboard assembly 100, while an additional flex circuit (not shown) may contain any suitable logic circuitry for processing input signals received by keyboard assembly 100. The additional flex circuit may form any suitable layer within keyboard assembly 100.

In some embodiments, flex layer 120 may contain one or more illumination sources 121, such as sources 121*a*, 121*d*, 121*f*, 121*k*, 121*n*, and 121*s* to provide general illumination to keypad layer 160 using any suitable approach. FIG. 1 illustrates one spatial arrangement of multiple illumination sources 121 within flex layer 120. Each illumination source 121 may be the same type of illumination source as or a different type of illumination source from another illumination source 121. Each illumination source 121 may be positioned on flex layer 120, but there may be a corresponding hole 127 in reflector sheet layer 125 and a corresponding hole 131 in light guide pipe layer 130 to allow each illumination source 121 to fit through the corresponding holes and emit light from the optical portion of each illumination source 121 through light guide pipe layer 130. For example, illumination source 121*a* may fit through hole 127*a* in reflector sheet layer 125 and hole 131*a* in light guide pipe layer 130 so that the light emitted by illumination source 121*a* may diffuse through light guide pipe layer 130 (i.e. at least in the X-Y plane of light guide pipe layer 130) while illumination source 121*a* is physically mounted upon flex layer 120.

Each illumination source 121 may be positioned anywhere within flex layer 120, such that each illumination source 121 may emit light primarily along an axis that may form any suitable angle with an edge 132 of light guide pipe layer 130 (within the X-Y plane of light guide pipe layer 130). For example, an illumination source 121 may emit light primarily along an axis that is parallel with edge 132. Although, in some embodiments, some light may be emitted upwardly towards mask layer 140 and downwardly towards reflector sheet layer 125 because an illumination source 121 may emit light in three dimensions (e.g., in X, Y, and Z directions of FIG. 1). Light that may be diffused through light guide pipe layer 130 by an illumination source 121 may also diffuse upwardly through one or more openings in mask layer 140, such as an unmasked portion 145, and through keyboard membrane layer 150 to illuminate one or more keys 105 on keypad layer 160.

Each one of illumination sources 121*a*, 121*d*, 121*f*, 121*k*, 121*n*, and 121*s* may be positioned on flex layer 120 to emit light into light guide pipe layer 130 primarily along an axis parallel to edge 132 as shown. However, in some embodiments, the position of each illumination source 121 relative to another illumination source 121 may not be along a single axis parallel to edge 132. For example, illumination sources

121*a* and 121*k* may each emit light primarily along an axis parallel to edge 132 and directed away from the middle portion of light guide pipe layer 130, and may be positioned anywhere between illumination sources 121*d* and 121*f* and illumination sources 121*n* and 121*s*, respectively.

Illumination sources 121*n*, 121*s*, 121*d* and 121*f* may each emit light primarily along an axis parallel to edge 132, directed toward the middle portion of light guide pipe layer 130, but may be positioned anywhere within flex layer 120. As shown in FIG. 1, for example, illumination sources 121*n* and 121*s* may be positioned on either side of illumination source 121*k* with respect to edge 132. But the position of illumination sources 121*n* and 121*s*, relative to illumination source 121*k*, may form any suitable angle with respect to edge 132, although the light emitted by illumination sources 121*n* and 121*s* may be parallel to edge 132.

In other embodiments, flex layer 120 may include any illumination source for generally illuminating keyboard assembly 100. For example, flex layer 120 may include a sheet at least partially made of or coated with an organic LED or an electroluminescent material, such as that described in commonly assigned U.S. Pat. No. 6,987,466, which is hereby incorporated by reference herein in its entirety, or any other material that may emit light if a voltage source is applied across it. Alternative arrangements of illumination sources positioned on flex layer 120 to emit light through light guide pipe layer 130 are described herein with respect to FIGS. 5-9.

Reflector sheet layer 125 may at least partially be made of any suitable material for reflecting light emitted within keyboard assembly 100 towards keypad layer 160. For example, reflector sheet layer 125 may at least partially be made of a white plastic sheet or a sheet of any other suitable material, and may include a reflective coating on its upper face 126 closest to light guide pipe layer 130. Alternatively, reflector sheet layer 125 may be a sheet that is reflective on its upper face 126 and lower face (not shown), or may be a sheet composed entirely of reflective material. If light guide pipe layer 130 is transparent, and if flex layer 120 includes one or more illumination sources 121, then some light emitted from one or more of the illumination sources 121 through light guide pipe layer 130 may diffuse downwardly towards reflector sheet layer 125 (e.g., downwardly at least partially in the Z direction of FIG. 1). Reflector sheet layer 125 may redirect at least some of the diffused light upwardly towards keypad layer 160 to help ensure that keypad layer 160 may be illuminated efficiently without requiring additional illumination sources. Reflector sheet layer 125 may include any suitable number of holes 127, such as holes 127*a*, 127*d*, 127*f*, 127*k*, 127*n*, and 127*s* that may traverse the depth of reflector sheet layer 125 to allow any illumination sources 121 of flex layer 120 to traverse reflector sheet layer 125 and to emit light into light guide pipe layer 130. In other embodiments, keyboard assembly 100 may not include reflector sheet layer 125, and flex layer 120 may be positioned between base layer 110 and light guide pipe layer 130. If reflector sheet layer 125 is not present, then base layer 110 may be at least partially made of any suitable material that is operative to reflect light emitted by one or more illumination sources 121 of flex layer 120 upwardly towards keypad layer 160.

Light guide pipe layer 130 may be at least partially made of any suitable material for diffusing light emitted within keyboard assembly 100. For example, light guide pipe layer 130 may include a transparent material, such as a flexible clear plastic sheet, that may allow light to travel along its length (i.e. in its X-Y plane). Light guide pipe layer 130 may also allow light to be reflected through it along any suitable path toward keypad layer 160 (e.g., in the Z-direction), the reflection of which may be aided by reflector sheet layer 125.

Light guide pipe layer 130 may include one or more holes 131, such as holes 131*a*, 131*b*, 131*d*, 131*f*, 131*j*, 131*k*, 131*n*, 131*q*, 131*s*, and 131*y* that may not traverse the full depth of light guide pipe layer 130, but may allow any illumination sources to traverse at least a portion of light guide pipe layer 130 to emit light into light guide pipe layer 130. Light guide pipe layer 130 may also contain one or more balancing slots (not shown) positioned within light guide pipe layer 130 that may be operative to balance the illumination between different regions of light guide pipe layer 130, such that keypad layer 160 may appear evenly illuminated.

Light guide pipe layer 130 may also contain one or more slots 153. Slots 153 may be formed using any suitable approach and may include any suitable configuration in order to keep light from diffusing beyond the slots. Slots 153 may reflect the light emitted by one or more illumination sources and may also deflect the light from diffusing in one or more undesired directions. For example, slot 153*z* may be an opening formed in light guide pipe layer 130 that may reflect the light emitted by an illumination source 151*y* of keyboard membrane layer 150 (described in more detail below) back towards illumination source 151*y* via total internal reflection. In some embodiments, slots 153 may be at least partially filled with any suitable opaque and/or reflective material. In some embodiments, slots 153 may traverse the depth of light guide pipe layer 130. Alternatively, in some embodiments, slots 153 may be embedded within light guide pipe layer 130 and may not contact any edge of light guide pipe layer 130.

Slot 153*z* may also deflect the light emitted by illumination source 151*y* from illuminating other keys 105 of keypad layer 160 other than the specific key or keys 105 desired to be illuminated. In addition, slot 153*z* may create a bounded area within light guide pipe layer 130, in which the light emitted by illumination source 151*y* may be contained and may continue to be reflected for enhancing the key-or-keys-specific illumination provided by illumination source 151*y*. In some embodiments, slots 153 may also be a reflecting plate (described in more detail below).

Similarly, illumination source 151*j* of keyboard membrane layer 150 (described in more detail below) may provide key-specific illumination to a specific key 105 of keypad layer 160 (e.g., the "ESCAPE" key 105*b*). Slot 153*r*, which may be the same as or different from other slots 153, and which may include some or all of the features of slot 153*z*, may prevent at least some of the light emitted by illumination source 151*j* from diffusing into undesired portions of light guide pipe layer 130 while reflecting at least some of the light back towards illumination source 151*j* to enhance the illumination of the specific key (e.g., "ESCAPE" key 105*b*).

Mask layer 140 may at least partially be made of any suitable material for directing light through one or more unmasked portions 145 provided through mask layer 140 for illuminating keypad layer 160. For example, mask layer 140 may be made of any opaque material, such as black plastic, for allowing some light to pass (through one or more unmasked portions 145) from illumination sources below mask layer 140 upwardly while blocking (e.g., reflecting) other light that may be attempting to pass through any other portion of mask layer 140 that may not be an unmasked portion 145. Mask layer 140 may include any number of unmasked portions 145, and each unmasked portion 145 may be of any suitable size and shape. One unmasked portion 145 is shown in FIG. 1 for the sake of simplicity and clarity. Unmasked portion 145 may be a hollow opening in mask layer 140 or a transparent material covering an opening in mask layer 140 to allow light to pass upwardly through unmasked portion 145 towards keypad layer 160. Mask layer 140 may also include any suitable number of holes 147, such as holes 147*b*, 147*j*, 147*q*, and 147*y* to allow any illumination sources positioned above mask layer 140, such as illumination sources 151*b*, 151*j*, 151*q*, and 151*y*, to pass through mask layer 140 and to emit light into light guide pipe layer 130.

In some embodiments, the location of unmasked portions 145 of mask layer 140 may correspond to the position of each of the keys 105 on keypad layer 160 (described in more detail below). In other embodiments, mask layer 140 may include a small number of unmasked portions 145, and unmasked portions 145 may be positioned to only allow illumination of one or more certain keys 105, or one unmasked portion may span several keys 105 on keypad layer 160, to allow light emitted from one or more illumination sources to illuminate more than one key on keypad layer 160. In other embodiments, keyboard assembly 100 may not contain mask layer 140, and light guide pipe layer 130 may include some or all of the features of mask layer 140. For example, light guide pipe layer 130 may include a pattern of openings, such as a dot pattern, that can focus the light diffusing through light guide pipe layer 130 such that the light may be at least partially diffused upwardly through the openings towards keypad layer 160 in a specific pattern to improve the illumination of the keys. One example of a dot pattern may include one dot for each key on keypad layer 160.

Keyboard membrane layer 150 may include any suitable mechanism for receiving any suitable inputs related to keyboard assembly 100 and transmitting any suitable information to any other suitable device. For example, keyboard membrane layer 150 may contain flex circuitry. Keyboard membrane layer 150 may convert an input from a user that may be received through keypad layer 160 into a signal that may be transmitted to any suitable device, such as the processing circuitry of a desktop computer or any other suitable electronic device. Keyboard membrane layer 150 may be of any suitable thickness, and may be compressible in response to receiving an input from a user on keypad layer 160. Keyboard membrane layer 150 may also be transparent to allow light emitted from lower layers within keyboard assembly 100 to travel through keyboard membrane layer 150 towards keypad layer 160.

Keyboard membrane layer 150 may also include one or more illumination sources 151 in any suitable position to provide illumination to keypad layer 160. For example, keyboard membrane layer 150 may include illumination sources 151*b*, 151*j*, 151*q*, and 151*y* to provide illumination to keypad layer 160. Illumination source 151*j* may be physically mounted to the underside of keyboard membrane layer 150, but illumination source 151*j* may also fit through hole 147*j* in mask layer 140 and hole 131*j* in light guide pipe layer 130 to allow illumination source 151*j* to emit light through light guide pipe layer 130.

In one embodiment, the user may wish to selectively illuminate a specific key 105*a* on keypad layer 160 (e.g., the "ENTER" key). Upon receiving any suitable input (e.g., from a processor of a computer associated with keyboard assembly 100), illumination source 151*b* may emit light away from the middle portion of light guide pipe layer 130 and generally toward edges 155, 157, and 159 (in the X-Y plane of light guide pipe layer 130). The light emitted by illumination source 151*b* may diffuse through light guide pipe layer 130 under key 105*a* toward slots 153*e*, 153*m*, and 153*x*. Slots 153*e*, 153*m*, and 153*x*, which may be the same as or different from other slots 153, and may include some or all of the features of slot 153*z*, may reflect at least some of the light emitted by illumination source 151*b* back towards illumination source 151*b* (in the X-Y plane of light guide pipe layer 130). Illumination source 151*b* and slots 153*e*, 153*m*, and 153*x* may also block at least some of the light from diffusing along light guide pipe layer 130 past slots 153*e*, 153*m*, and 153*x* to prevent the light from illuminating keys other than key 105*a*. Slots 153*e*, 153*m*, 153*x*, and any other slots within 10 light guide pipe layer 130 may be positioned such that they do not overlap with the unmasked portions 145 of mask layer 140 and may prevent light emitted into light guide pipe layer 130 from traveling through an unmasked portion 145 of mask layer 140 upwardly towards keypad layer 160.

In some embodiments, any illumination source within keyboard assembly 100 may provide variable illumination to keypad layer 160. Keyboard assembly 100 may form a part of a device (e.g., a laptop computer) or may be externally coupled to another device wirelessly or through a cable 190 (e.g., a desktop computer with a display screen). The display screen of the electronic device may present an image that may request input from a user. In response to this image being presented, keyboard assembly 100 may receive input from the device that instructs keyboard assembly 100 to illuminate one or more keys to guide the user in providing responsive input. Keyboard assembly 100 may then signal the appropriate illumination source or sources to emit light. If the input received by keyboard assembly 100 from the device changes (e.g., the laptop or desktop computer sends a new input to keyboard assembly 100 in a real-time fashion), then keyboard assembly 100 may continue to signal the same or different illumination sources to emit light as appropriate to guide the user.

For example, the user may be presented with an image on a display screen that requires the user to "tab" through the image. The device may transmit a device input to keyboard assembly 100 that instructs keyboard assembly 100 to signal illumination source 151*q* to emit light. Illumination source 151*q* may emit light in response to a device signal from keyboard assembly 100, and the light may diffuse through light guide pipe layer 130, away from illumination source 151*q* and underneath the "TAB" key 105*c* on keypad layer 160, thereby illuminating the key of interest to the user. Light emitted by illumination source 151*q* may be reflected toward the "TAB" key 105*c* on keypad layer 160 using reflector sheet layer 125. Slots 153*a* and 153*b*, which may be the same as or different from other slots 153, and may include some or all of the features of slot 153*z*, may also prevent light emitted by illumination source 151*q* from illuminating other keys 105 on keypad layer 160. If the "TAB" key is no longer helpful to the user in navigating an image on a display screen, then the device may send a device input to keyboard assembly 100 to signal illumination source 151*q* to stop emitting light. Thus, the "TAB" key 105*c* may not be illuminated and the user may thereby realize that the "TAB" key 105*c* is no longer needed.

Keypad layer 160 may include any suitable mechanism for receiving user inputs to keyboard assembly 100. Keypad layer 160 may be at least partially made of any suitable material, such as plastic or metal. Keypad layer 160 may include any suitable arrangement of keys 105 for presentation to a user, and may include any suitable legend scheme in any suitable arrangement to denote each key 105 on keypad layer 160. For example, keypad layer 160 may include a legend scheme representing letters or characters of a particular language. Alternatively, keypad layer 160 may include a legend scheme representing symbols or operations. As a further alternative, keypad layer 160 may include both characters and symbols.

Figure 2:
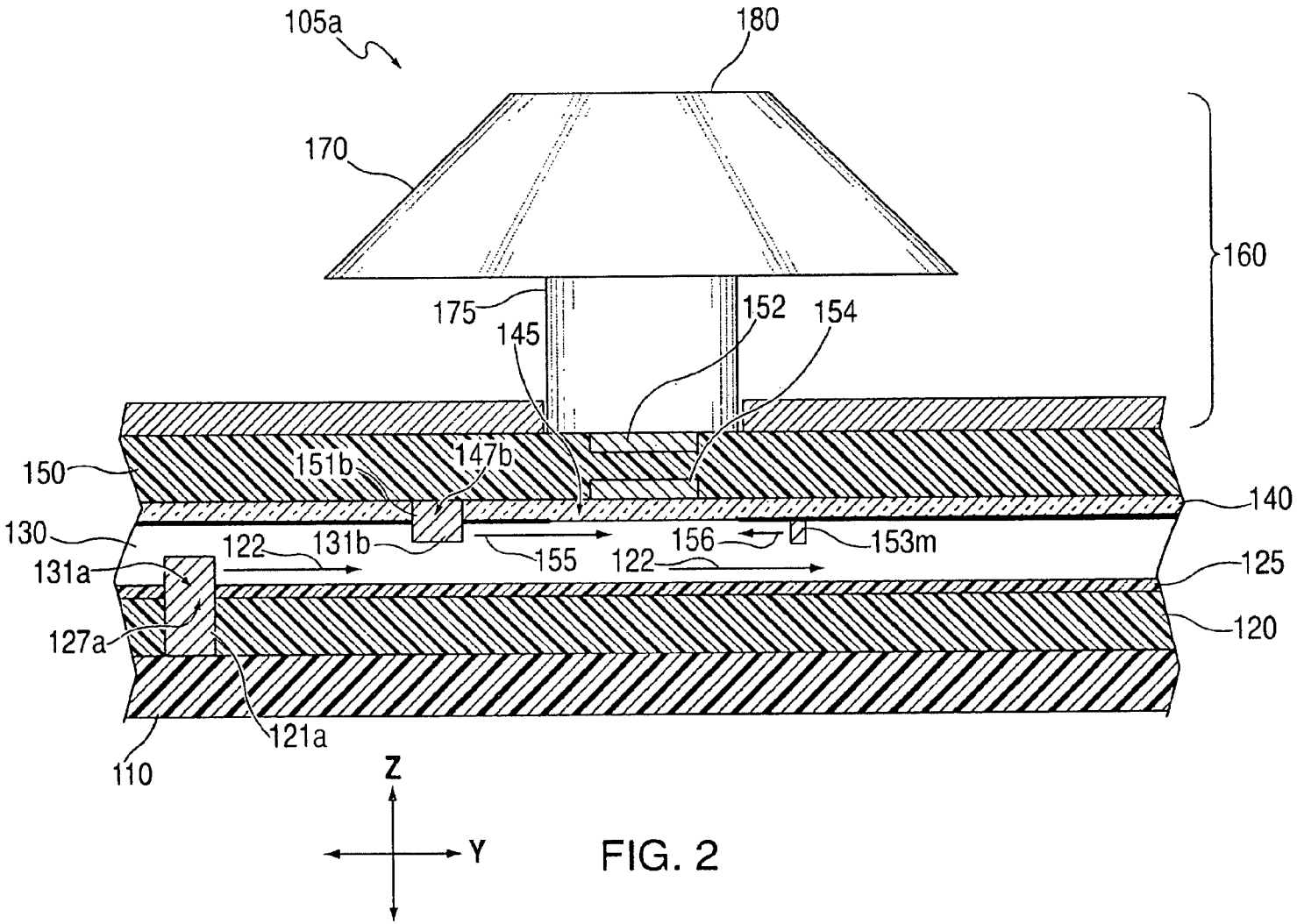
FIG. 2 shows a cross-sectional view of a portion of the keyboard assembly of FIG. 1 in accordance with some embodiments of the invention.

FIG. 2 shows a cross-sectional view of a portion of keyboard assembly 100 of FIG. 1 that includes individual key

105*a* in accordance with some embodiments of the invention. Key 105*a* may form a part of keypad layer 160, and may be mounted above base layer 110, flex layer 120, reflector sheet layer 125, light guide pipe layer 130, mask layer 140, and keyboard membrane layer 150. Key 105*a* may include a striking surface 180, keycap 170, key mount 175, conducting plates 152 and 154, and any other suitable features. Other keys 105 on keypad layer 160 may be the same as or different from key 105*a*, and may include some or all of the features of key 105*a*. The shape of keycap 170 may take any shape suitable, and striking surface 180 may be of any size or shape suitable, relative to keycap 170, to present a legend to and receive a user input from a user. Key mount 175 may be coupled to the top surface of keyboard membrane layer 150 and to the underside of keycap 170.

Keyboard membrane layer 150 may include conducting plates 152 and 154. Conducting plate 152 may be coupled to the top of keyboard membrane layer 150, underneath key 105*a*, and conducting plate 154 may be coupled to the bottom of keyboard membrane layer 150. The plates may include or may be coated with any material capable of conducting electricity. When placed in contact with one another, conducting plates 152 and 154 may complete an electrical circuit. For example, if a user strikes key 105*a* on striking surface 180, key mount 175 may move downward, causing keyboard membrane layer 150 to compress and thereby moving conducting plate 152 downwardly. Conducting plate 152 may contact conducting plate 154 as a result of the compression and an electrical circuit may be completed by the contact. The completion of the electrical circuit may generate an electrical keyboard input that keyboard membrane layer 150 may transmit to any suitable device, such as the processor of a desktop computer or a laptop computer associated with keyboard assembly 100, to process the keyboard input.

In one embodiment, key 105*a* may be generally illuminated using any suitable approach. For example, illumination source 121*a* may be mounted on flex layer 120 and may pass through holes 127*a* and 131*a* to emit light generally in the direction 122 through a portion of light guide pipe layer 130 lying underneath key 105*a*. Light that diffuses in the direction of arrows 122 under unmasked portion 145 in mask layer 140 may pass through mask layer 140 to keypad layer 160 and may illuminate key 105*a* using any suitable approach. For example, light from illumination source 121*a* may illuminate all of keycap 170 if keycap 170 is transparent. Alternatively, the legend (not shown) on striking surface 180 may be transparent while keycap 170 may be opaque, and light from illumination source 121*a* may illuminate only the legend. As another alternative, there may be a hole or window (not shown) near the legend on striking surface 180, and light from illumination source 121*a* may illuminate only the hole. As shown, for example, light emitted by illumination source 121*a* and diffused in direction 122 may not be reflected back by slot 153*m* because slot 153*m* may not span the height of light guide pipe layer 130 and may not impede the diffusion of light in direction 122.

In some embodiments, key 105*a* may also be selectively illuminated using any suitable approach. For example, illumination source 151*b* may be coupled to the underside of keyboard membrane layer 150, but may be inserted through holes 147*b* and 131*b* to emit light generally in the direction of arrow 155 and underneath key 105*a*. A portion of the light that diffuses under key 105*a* along direction 155 may diffuse upwardly through unmasked portion 145 of mask layer 140 and keyboard membrane layer 150 to illuminate key 105*a*, but another portion of the light may also reach slot 153*m*, slot 153*e* (not shown in FIG. 2), and slot 153*x* (not shown in FIG. 2). Slots 153*m*, 153*e*, and 153*x*, which may not be overlapping with openings like unmasked portion 145 in mask layer 140, may reflect the light emitted by illumination source 151*b* in the direction of arrow 156 back towards illumination source 151*b*. The location of slots 153*m*, 153*e*, and 153*x*, along with the lack of alignment between the slots in light guide pipe layer 130 and the unmasked portion 145 in mask layer 140, may prevent illumination source 151*b* from selectively illuminating keys other than key 105*a*.

In some embodiments, key 105*a* may be variably illuminated. For example, keyboard assembly 100 may form a part of or may be coupled to an electronic device, such as a desktop computer or a laptop computer. Keyboard assembly 100 may receive a device input from the device instructing the keyboard to illuminate key 105*a* and may thereby signal illumination source 151*b* to emit light (e.g., the user may be presented with an image on a display screen of the device that requires the user to hit the "ENTER" key 105*a* to advance to the next image on the display screen). Illumination source 151*b* may emit light in response to a signal from keyboard assembly 100 or in response to the device input instruction itself, and the light may diffuse away from illumination source 151*b* and underneath key 105*a*, thereby illuminating the key of interest to the user. If the device input changes (e.g., key 105*a* is no longer necessary to navigate the display screen), then the device may instruct keyboard assembly 100 to signal illumination source 151*b* to stop emitting light. The lack of illumination of key 105*a* may inform the user that key 105*a* is no longer needed.

Illumination source 151*b* may emit light to distinguish key 105*a* from other keys that may be illuminated using any suitable approach of the invention. For example, illumination source 151*b* may emit light of a different color than that emitted by illumination source 121*a*. Alternatively, illumination source 151*b* may emit a blinking light while illumination source 121*a* may emit a constant light signal. Alternatively, illumination source 151*b* may emit light of the same color as that emitted by illumination source 121*a*, but with a stronger intensity.

Figure 3:
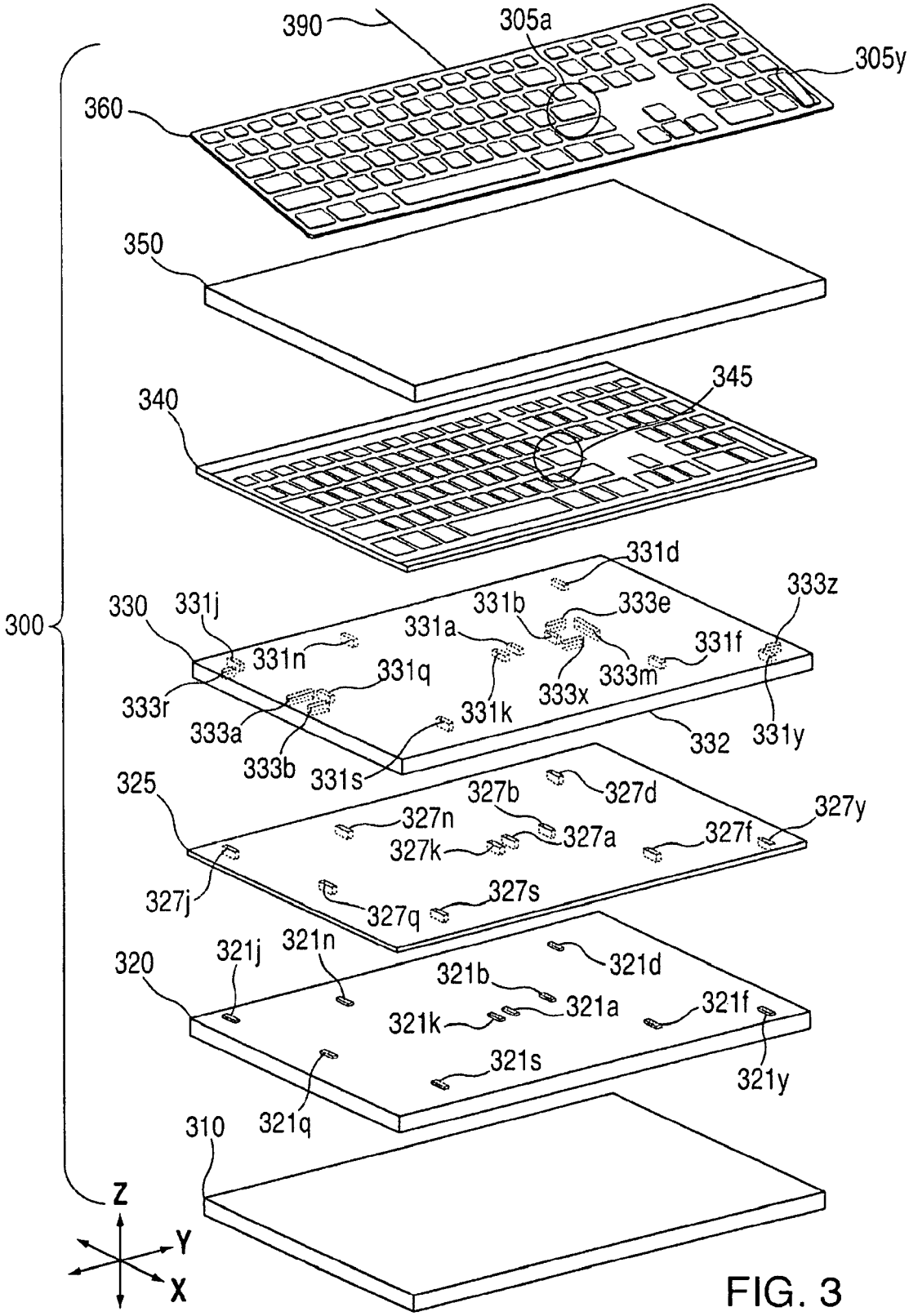
FIG. 3 shows an exploded perspective view of a keyboard assembly in accordance with some embodiments of the invention.

FIG. 3 shows an exploded perspective view of a keyboard assembly in accordance with some embodiments of the invention. Keyboard assembly 300 may include base layer 310, flex layer 320, reflector sheet layer 325, light guide pipe layer 330, mask layer 340, keyboard membrane layer 350, and keypad layer 360, each of which may be the same as or different from, and may include some or all of the features of, base layer 110, flex layer 120, reflector sheet layer 125, light guide pipe layer 130, mask layer 140, keyboard membrane layer 150, and keypad layer 160, respectively (of FIGS. 1 and 2). Keyboard assembly 300 may also include one or more illumination sources, which may be positioned anywhere within keyboard assembly 300. Each illumination source may be the same as, or different from, other illumination sources. Keyboard assembly 300 may also include one or more flex circuits, one or more slots in one or more layers, and one or more voltage sources.

In some embodiments, one or more illumination sources 321 may be located in a layer within keyboard assembly 300 to illuminate keyboard assembly 300. For example, illumination sources 321*a*, 321*d*, 321*f*, 321*k*, 321*n*, and 321*s*, which may be the same as or different from illumination sources 121*a*, 121*d*, 121*f*, 121*k*, 121*n*, and 121*s* (FIG. 1), may provide general illumination to keyboard assembly 300 using any suitable approach. Each of these illumination sources 321 may be positioned anywhere on flex layer 320, and each illumination source may pass through holes 327*a*, 327*d*, 327*f*, 327*k*, 327*n*, and 327*s*, respectively, in reflector sheet layer 325 and through holes 331*a*, 331*d*, 331*f*, 331*k*, 331*n*, and 331*s*, respectively, in light guide pipe layer 330. In some embodiments, reflector sheet layer 325 may not be present, and flex layer 320 may be positioned between base layer 310 and light guide pipe layer 330. If reflector sheet layer 325 is not present in keyboard assembly 300, then base layer 310 may be made of any suitable material that is operative to reflect light emitted by flex layer 320 upwardly towards keypad layer 360. Base layer 310 may also be made of any suitable material that may be bent up through an opening in light guide pipe layer 330 to provide an additional reflecting surface for light diffusing through light guide pipe layer 330 (e.g., in the X-Y plane).

Each of illumination sources 321*a*, 321*d*, 321*f*, 321*k*, 321*n*, and 321*s* may emit light into light guide pipe layer 330 along an axis that may form any suitable angle with edge 332 within the X-Y plane of light guide pipe layer 330. In addition, the position of each general illumination source relative to another general illumination source may create any suitable angle (e.g., illumination sources 321*a*, 321*d*, 321*f*, 321*k*, 321*n*, and 321*s* may be positioned to emit light primarily along an axis parallel to edge 332, but the position of each of these illumination sources relative to each other may not be along the same axis). Light that may be emitted by any of these illumination sources 321 may be diffused through light guide pipe layer 330 generally in the X-Y plane, may be reflected upwardly through unmasked portions of mask layer 340 (e.g., unmasked portion 345) through keyboard membrane layer 350 (generally in the Z-axis), and may illuminate keys on keypad layer 360.

In some embodiments, illumination sources 321*a* and 321*k* may each emit light in opposite directions along the X-Y plane, but each primarily along an axis parallel to edge 332, and directed away from the middle portion of light guide pipe layer 330. Illumination sources 321*n*, 321*s*, 321*d*, and 321*f* may each emit light along an axis parallel to edge 332, directed generally toward the middle portion of light guide pipe layer 330, but may be positioned anywhere within flex layer 320. In FIG. 3, for example, illumination sources 321*n* and 321*s* may be positioned on either side of illumination source 321*k*. But the position of illumination sources 321*n* and 321*s*, relative to illumination source 321*k* with respect to edge 332, may form any suitable angle with edge 332, although the light emitted by illumination sources 321*n* and 321*s* may be parallel to edge 332.

Flex layer 320 also may contain one or more illumination sources to provide selective or variable illumination of keypad layer 360 using any suitable approach. For example, flex layer 320 may contain one or more illumination sources, such as illumination sources 321*b*, 321*j*, 321*q*, and 321*y*, positioned anywhere within flex layer 320 to provide key-specific illumination to particular keys 305 of keyboard assembly 300. By positioning these illumination sources on flex layer 320, keyboard membrane layer 350 may not include any illumination sources. As a result, more space may exist on keyboard membrane layer 350 to make conducting plates 352 and 354 (see, e.g., FIG. 4) larger, which may enhance the sensitivity of keyboard membrane layer 350 to user inputs on keys 305 of keypad layer 360.

Each of illumination sources 321*b*, 321*j*, 321*q*, and 321*y* may be positioned anywhere on flex layer 320, and each illumination source may pass through holes 327*b*, 327*j*, 327*q*, and 327*y* in reflector sheet layer 325 and through holes 331*b*, 331*j*, 331*q*, and 331*y*, in light guide pipe layer 330 respectively, in order to emit light into light guide pipe layer 330. Light guide pipe layer 330 may also contain balancing slots (not shown) that may be operative to balance the illumination between different regions of light guide pipe layer 330, such that keypad layer 360 may appear evenly illuminated.

In some embodiments, a user of keyboard assembly 300 may wish to selectively illuminate a key 305*a* on keypad layer 360 (e.g., the "ENTER" key). Upon receiving any suitable input, illumination source 321*b* may emit light away from the middle portion of light guide pipe layer 330 (e.g., away from illumination source 321*a*). When the light emitted by illumination source 321*b* diffuses through light guide pipe layer 330 under key 305*a*, the light may also reach slots 333*e*, 333*m*, and 333*x*. Slots 333*e*, 333*m*, and 333*x*, each of which may be the same as or different from, and may include some or all of the features of slots 153*e*, 153*m*, and 153*x* (FIG. 1), may reflect the light emitted by illumination source 321*b* back towards illumination source 321*b* while also deflecting the diffused light away from other portions of light guide pipe layer 330 beyond slots 333*e*, 333*m*, and 333*x* to prevent the light from illuminating keys other than key 305*a*. Because slots 333*e*, 333*m*, and 333*x* may diffuse at least some of the light from illumination source 321*b* downwardly onto reflector sheet layer 325, reflector sheet layer 325 may reflect the diffused light back upwardly towards light guide pipe layer 330. If slots 333*e*, 333*m*, 333*x*, and any other slots within light guide pipe layer 330 are positioned such that they do not overlap with any of the unmasked portions 345 within mask layer 340, then light reflected back through any slots within light guide pipe layer 330 by reflector sheet layer 325 may be blocked from diffusing further through mask layer 340.

In some embodiments, any illumination source emitting light into light guide pipe layer 330 may provide variable illumination to keypad layer 360 to aid a user. Keyboard assembly 300 may form a part of a device (e.g., a laptop computer) or may be externally coupled to another device through a cable 390 (e.g., a desktop computer with a display screen). Keyboard assembly 300 may also communicate wirelessly with another device without using cable 390. The display screen of the laptop or desktop computer may present an image that may request input from a user. In response to this image being presented, keyboard assembly 300 may receive a device input from the device that instructs keyboard assembly 300 to illuminate one or more keys 305 (e.g., "ENTER" key 305*y*) to guide the user in providing one or more responsive inputs in response to the image of the display screens. Keyboard assembly 300 may signal the appropriate illumination source or sources to emit light (e.g., illumination source 321*y*) and to alert the user that one or more particular keys may be used to navigate the display screen (e.g., "ENTER" key 305*y* of the number pad). If the input from the device changes such that the specific key or keys no longer need to be illuminated, then keyboard assembly 300 may signal illumination source 321*y* to stop emitting light, thereby indicating to the user that that key may no longer be needed to navigate the display screen.

Figure 4:
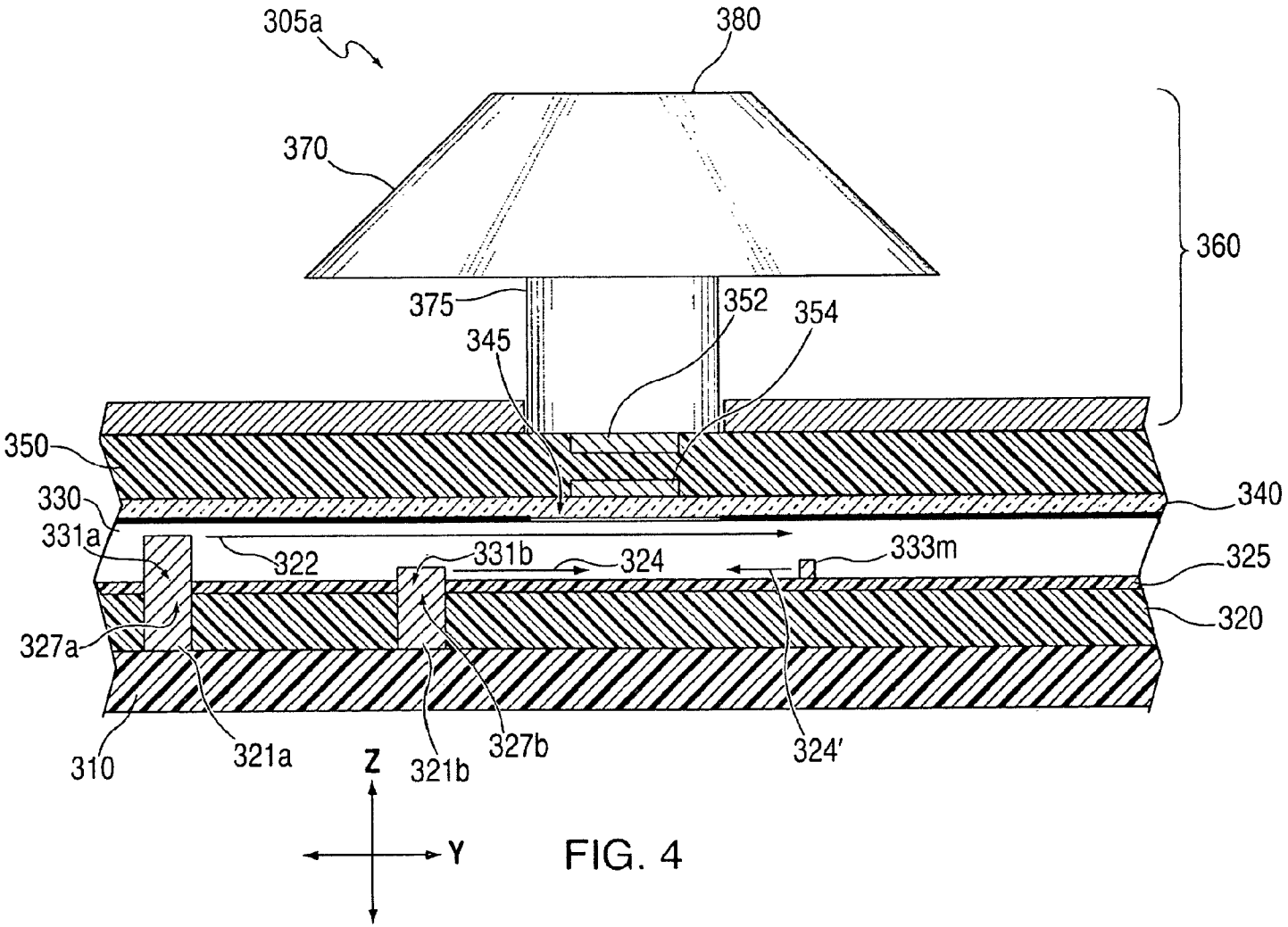
FIG. 4 shows a cross-sectional view of a portion of the keyboard assembly of FIG. 3 in accordance with some embodiments of the invention.

FIG. 4 shows a cross-sectional view of a portion of the keyboard assembly of FIG. 3 in accordance with some embodiments of the invention. Key 305*a* may be a part of keypad layer 360, and may be mounted above base layer 310, flex layer 320, reflector sheet layer 325, light guide pipe layer 330, mask layer 340, and keyboard membrane layer 350 (FIG. 3). Key 305*a* may include striking surface 380, keycap 370, key mount 375, and conducting plates 352 and 354, each of which may be the same as or different from, and may include some or all of the features of, striking surface 180, keycap 170, key mount 175, and conducting plates 152 and 154, respectively (see, e.g., FIGS. 1 and 2). Other keys 305 on keypad layer 360 may be the same as or different from, and may include some or all of the features of, key 305*a*. The shape of keycap 370 may take any suitable shape, and striking surface 380 may be of any suitable size or shape, relative to keycap 370, to present a legend to and to receive an input from a user.

In some embodiments, key 305*a* may be generally illuminated using any suitable approach. For example, illumination source 321*a* may be mounted on flex layer 320 and may fit through holes 327*a* and 331*a* to emit light generally in the direction of arrow 322 through a portion of light guide pipe layer 330 underneath key 305*a*. Light that diffuses in direction 322 under unmasked portion 345 of mask layer 340 may pass upwardly through mask layer 340 to keypad layer 360 and may illuminate key 305*a* using any suitable approach. For example, light from illumination source 321*a* may illuminate all of keycap 370 if keycap 370 is transparent. Alternatively, a legend (not pictured) on striking surface 380 may be transparent while keycap 370 may be opaque, and light from illumination source 321*a* may illuminate only the legend. As another alternative, there may be a hole or window (not shown) near a legend on striking surface 380, and light from illumination source 321*a* may illuminate only the hole. At least some of the light emitted by illumination source 321*a* and diffusing in the direction of arrow 322 may not be reflected back by slot 333*m* because slot 333*m* may not span the height of light guide pipe layer 330 and may not impede the diffusion of at least some of the light emitted in direction 322 by illumination source 321*a*.

In some embodiments, key 305*a* also may be selectively illuminated using any suitable approach. For example, illumination source 321*b* may be mounted on flex layer 320 and may fit through holes 327*b* and 331*b* to emit light generally in the direction of arrow 324 through a portion of light guide pipe layer 330 underneath key 305*a*. Light that diffuses under key 305*a* along direction 324 may illuminate key 305*a*, but the light may also reach slot 333*m*, slot 333*e* (not shown), and slot 333*x* (see, e.g., FIG. 3). Slots 333*m*, 333*e*, and 333*x*, which may not be overlapping with unmasked portions 345 of mask layer 340, may reflect at least some of the light emitted by illumination source 321*b* in the direction of arrow 324' back towards illumination source 321*b*. The location of slots 333*m*, 333*e*, and 333*x*, coupled with the lack of alignment between the slots in light guide pipe layer 330 and the unmasked portions 345 of mask layer 340 may prevent illumination source 321*b* from selectively illuminating keys other than key 305*a*.

In some embodiments, although illumination sources 321*a* and 321*b* may be in the same layer within keyboard assembly 300 and may be emitting at least some light in the same direction within light guide pipe layer 330, all of the light emitted by illumination source 321*a* may not be obstructed by illumination source 321*b*. For example, illumination source 321*b* may not protrude into light guide pipe layer 330 as far as illumination source 321*a* (e.g., illumination source 321*a* may be larger than illumination source 321*b*), thereby allowing at least some of the light emitted by illumination source 321*a* to diffuse in direction 322 over illumination source 321*b* and upwardly through unmasked portion 345. Alternatively, illumination source 321*b* may emit light at a lesser intensity, relative to the intensity of the light that may be emitted by illumination source 321*a*, to allow the more intense light from illumination source 321*a* to illuminate key 305*a* even if illumination source 321*b* obstructs some of the diffusion of the light from illumination source 321*a* through light guide pipe layer 330. As another alternative, one illumination source may be positioned at the bottom of light guide pipe layer 330, while the other illumination source may be positioned at the top of light guide pipe layer 330, so that each illumination source may emit light without obstructing the emission of the other illumination source. For example, if illumination source 321*b* were to be mounted from keyboard membrane layer 350 and powered by keyboard membrane layer 350, while emitting light into the body of light guide pipe layer 330, then slots 333*m*, 333*e*, and 333*x* may be moved correspondingly to the top of light guide pipe layer 330.

In some embodiments, key 305*a* may be variably illuminated to aid a user. Keyboard assembly 300 may form a part of or may be coupled to a device such as a desktop computer or a laptop. Keyboard assembly 300 may receive a device instruction from the device to illuminate key 305*a* and may signal illumination source 321*b* to emit light in response thereto (e.g., the user may be presented with an image on a display screen of a computer that requires the user to hit the "ENTER" key to advance to the next image on the display screen). Illumination source 321*b* may emit light in response to a signal from keyboard assembly 300, and the light may diffuse away from illumination source 321*b* in direction 324 and underneath key 305*a*, thereby illuminating the key of interest to the user. If the device input changes (e.g., key 305*a* is no longer necessary to navigate the display screen of the device), then the device may instruct keyboard assembly 300 to signal illumination source 321*b* to stop emitting light. The lack of illumination of key 305 may inform the user that key 305*a* is no longer needed.

Illumination source 321*b* may emit light to distinguish key 305*a* from other keys that may be illuminated using any suitable approach. For example, illumination source 321*b* may emit light of a different color than that emitted by illumination source 321*a*. Alternatively, illumination source 321*b* may emit a blinking light while illumination source 321*a* may emit a constant light signal or illumination source 321*b* may emit light of the same color as that emitted by illumination source 321*a*, but of a different intensity.

A keyboard may be generally, selectively, or variably illuminated using one or more illumination sources positioned in any suitable manner. FIGS. 5, 6, 7, 8, and 9 each shows a top view of a distribution of illumination sources in a portion of a keyboard assembly in accordance with some embodiments of the invention. The keyboard layer portrayed within each of FIGS. 5, 6, 7, 8, and 9 may be the same as or different from, and may include some or all of the features of, the other keyboard layers portrayed within FIGS. 5, 6, 7, 8, and 9. In each of FIGS. 5, 6, 7, 8, and 9, the layer shown may be a light guide pipe. Each light guide pipe may be the same as or different from, and may include some or all of the features of, light guide pipe layer 130 (FIGS. 1 and 2) or light guide pipe layer 330 (FIGS. 3 and 4). For example, each light guide pipe pictured in FIGS. 5, 6, 7, 8, and 9 may also contain reflecting plates or slots to reflect or channel light, holes to permit illumination sources to emit light into the light guide pipe (not shown), or any other suitable feature.

Each light guide pipe may employ any suitable number of illumination sources to provide general, selective, or variable illumination to a keyboard. For example, FIGS. 5, 6, 7, 8, and 9 present different embodiments that may include an odd number or an even number of illumination sources, such as LEDs, to illuminate a keyboard. Each illumination source may be the same as, or different from, all other illumination sources within each light guide pipe. Each illumination source may be powered using any suitable approach, such as through a connection to a flex layer like flex layer 120 or keyboard membrane layer 150 (FIG. 1). Each illumination source may be physically mounted to any suitable layer, such as flex layer 120 or keyboard membrane layer 150, but in some embodiments, the optical portion of each illumination source may extend into the light guide pipe to emit light into the light guide pipe. Each illumination source that may be accompanied by a reflecting plate (described in more detail below) may emit light upwardly into its respective light guide pipe generally perpendicular to the X-Y plane, or it may emit light sideways along its respective light guide pipe generally along the X-Y plane. Alternatively, each illumination source that may be accompanied by a reflecting plate may emit light at any suitable angle with respect to the X-Y plane of its respective light guide pipe. In FIGS. 5, 6, 7, 8, and 9, each illumination source may be an LED for simplicity in describing the invention, although any other type of illumination source may be used.

Figure 5:
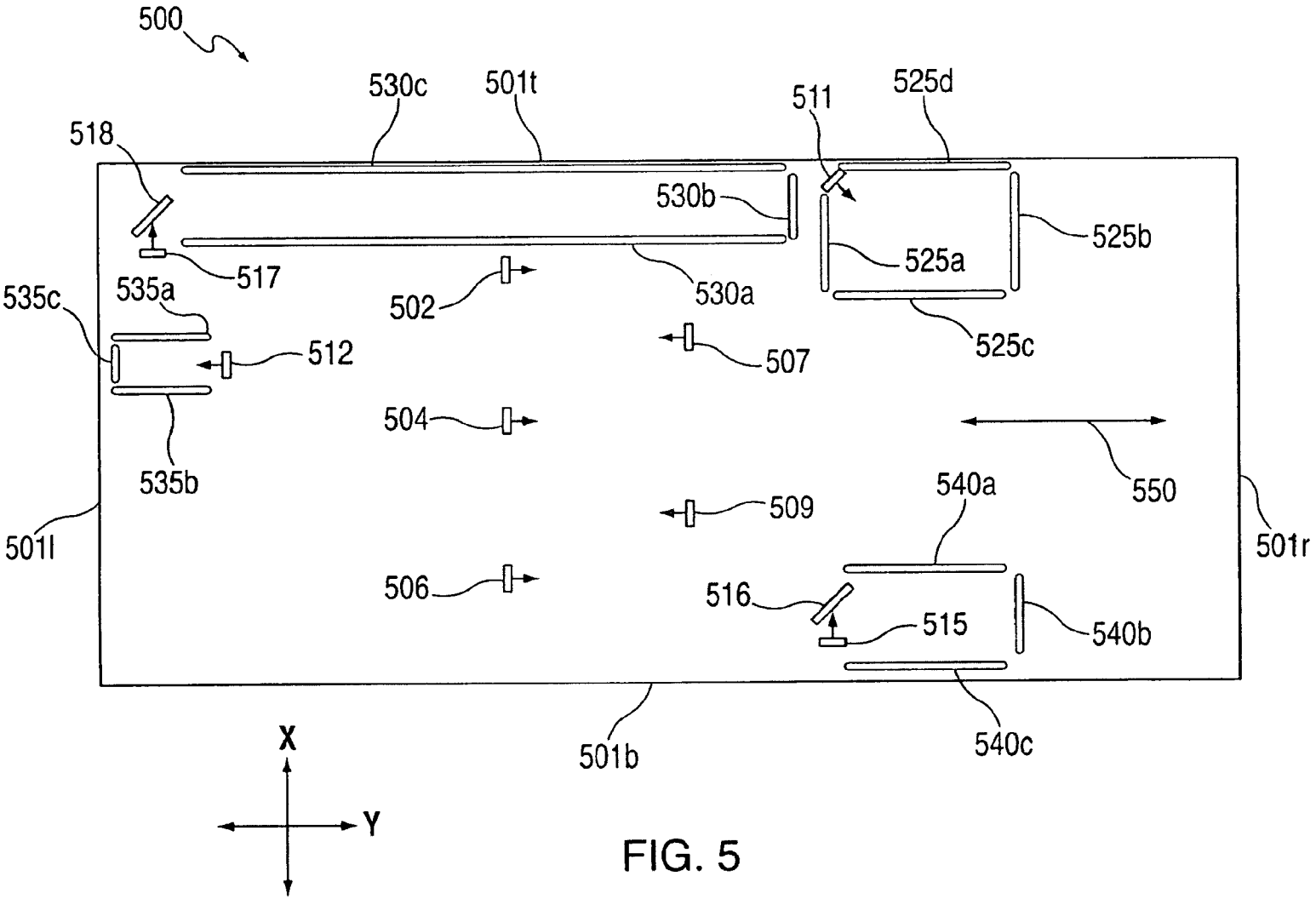
FIG. 5 shows a vertical cross-sectional view of a distribution of illumination sources in a portion of a keyboard assembly in accordance with some embodiments of the invention.

FIG. 5 is a vertical cross-sectional view of a distribution of illumination sources in accordance with some embodiments of the invention. Light guide pipe 500 may provide any suitable arrangement of illumination sources to provide general illumination to a keyboard. For example, LED 502, LED 504, and LED 506 may be positioned on a flex layer (e.g., flex layer 120 of FIG. 1) so that each may emit light along an axis parallel to longitudinal axis 550 toward the middle portion of light guide pipe 500. LED 507 and LED 509 may also be positioned on a flex layer so that each may emit light along an axis parallel to longitudinal axis 550 toward the middle portion of light guide pipe 500. More LEDs may emit light toward the right side of light guide pipe 500 because the right side of the keyboard above light guide pipe 500 may contain more keys than the left side.

LEDs 502, 504, and 506 may generally emit light parallel to but opposite to the light emitted from LEDs 507 and 509. LED 507 may be positioned anywhere suitable between LED 502 and LED 504 so as to emit light in a direction opposite to, but without overlapping entirely, the light emitted by LED 502 and LED 504 (e.g., LED 507 may be at least partially offset along the X-axis and/or the Y-axis of light guide pipe 500 with respect to LED 502 and LED 504).
Similarly, LED 509 may be positioned anywhere suitable between LED 504 and LED 506 so as to emit light in a direction opposite to, but without overlapping entirely, the light emitted by LEDs 504 and 506 (e.g., LED 509 may be at least partially offset along the X-axis and/or the Y-axis of light guide pipe 500 with respect to LED 504 and LED 506). At least some of the light emitted by LED 507 may pass between LEDs 502 and 504, and at least some of the light emitted by LED 509 may pass between LEDs 504 and 506, to allow light to illuminate the left side of light guide pipe 500. The light emitted by these five LEDs may diffuse across the length of light guide pipe 500 to generally illuminate a keyboard. Diffused light may be redirected toward the keyboard using any suitable method. In one embodiment, a reflector sheet may be positioned underneath light guide pipe 500 to direct the diffused light upwardly through light guide pipe 500, and a mask layer may be positioned above light guide pipe 500 to channel the diffused light upwardly through unmasked portions toward the keypad (e.g., reflector sheet layer 125 and unmasked portions 145 of mask layer 140 of FIGS. 1 and 2).

In addition or as an alternative to the general illumination that may be provided by LEDs 502, 504, 506, 507, and 509, light guide pipe 500 may contain any suitable number of illumination sources to selectively or variably illuminate a keyboard using any suitable approach. For example, light guide pipe 500 may include one or more illumination sources accompanied by one or more reflective surfaces for redirecting emitted light towards particular keys of interest. In FIG. 5, LED 515 and LED 517 may be provided within light guide pipe 500 near reflecting plates 516 and 518, respectively.

Reflecting plates 516 and 518 may include any suitable configuration for reflecting light. In some embodiments, reflecting plates 516 and 518 may include mirrors mounted within light guide pipe 500. In other embodiments, reflecting plates 516 and 518 may include flat, curved, or V-shaped plates coated with a reflective substance. In further embodiments, reflecting plates 516 and 518 may include a reflective material, such as metal, provided by another layer (e.g., material from base layer 110 of FIGS. 1 and 2) that may be bent or otherwise formed into light guide pipe 500 to provide a reflecting surface. In some further embodiments, reflecting plates 516 and 518 may include edges positioned within a layer that may be plated with a reflective substance or that may be placed at a high angle within the layer in order to spread light emitted by an illumination source via total internal reflection. Reflecting plates 516 and 518, while allowing light from illumination sources to be reflected in any suitable direction within light guide pipe 500, may also permit at least some light to diffuse through them. Reflecting plates 516 and 518 may be positioned anywhere within light guide pipe 500 to aid LEDs 515 and 517 in selectively or variably illuminating particular keys of interest. In some embodiments, reflecting plates 516 and 518 may be angled to face in any suitable direction other than what is pictured in FIG. 5 to provide illumination to different keys.

LEDs 515 and 517 may be used with reflecting plates 516 and 518, respectively, to selectively or variably illuminate particular keys of interest using any suitable approach. For example, LED 515 may illuminate the arrow keys on a standard keyboard (e.g., arrow keys 105*w* of keyboard assembly 100 of FIG. 1). LED 515 may be mounted to a flex layer above or below light guide pipe 500, such as flex layer 120 or keyboard membrane layer 150 of FIGS. 1 and 2 to obtain power, but LED 515 may emit light upwardly into or sideways along light guide pipe 500. For simplicity, LED 515 is described with respect to FIG. 5 as being mounted below light guide pipe 500. Upon receiving an appropriate input, LED 515 may emit light upwardly into or sideways along light guide pipe 500 and reflecting plate 516 may reflect the emitted light generally towards the right edge 501*r* of light guide pipe 500, in a direction generally parallel with longitudinal axis 550, and underneath the specifically desired key or keys. The emitted and reflected light may diffuse upwardly towards the particular key or keys of interest to illuminate them. The light may diffuse through one or more suitable layers before illuminating the key or keys, such as a mask layer and a keyboard membrane layer.

The light that may be emitted by LED 515 and reflected toward the keys of interest by reflecting plate 516 may be prevented from diffusing toward undesired portions of light guide pipe 500 using any suitable approach. For example, there may be perforations provided in light guide pipe 500, such as slots 540*a*-540*c*, which may be the same as or different from, and may include some or all of the features of the slots described in FIGS. 1-4. Slots 540*a*-540*c* may channel light emitted by LED 515 away from light guide pipe 500 while also reflecting light back towards LED 515. Slots 540*a*-540*c* may be positioned anywhere suitable in light guide pipe 500 to aid LED 515 and reflecting plate 516 in illuminating only the key or keys of interest. In FIG. 5, slot 540*a* may be positioned to prevent the light emitted by LED 515 and reflected by reflecting plate 516 from diffusing into a portion of light guide pipe 500 underneath other keys. Similarly, slot 540*b* may be positioned to prevent the same light from diffusing further along light guide pipe 500 towards right edge 501*r*. Light guide pipe 500 may also include a third slot 540*c* parallel to slot 540*a* and positioned to the right of LED 515 to prevent light from diffusing out along bottom edge 501*b* of light guide pipe 500. Slots 540*a*-540*c* may also reflect light back into the area of light guide pipe 500 bounded by the slots and reflecting plate 516 to enhance the particular illumination of the key or keys of interest.

LED 517 may also be used to illuminate a particular key or keys of interest, such as the number keys along the top edge of a standard keyboard (e.g., number keys 105*n* of FIG. 1), using any suitable approach. For simplicity, LED 517, like LED 515, is described with respect to FIG. 5 as being mounted below light guide pipe 500. The position of LED 517 relative to reflecting plate 518 within light guide pipe 500 is described in more detail with respect to FIG. 5A below. Upon receiving an appropriate input, LED 517 may emit light upwardly into or sideways along light guide pipe 500 and reflecting plate 518 may reflect the emitted light generally towards the right edge 501*r* of light guide pipe 500, in a direction generally parallel with axis 550, and underneath the keys of interest. The emitted and reflected light may diffuse upwardly toward the particular keys of interest to illuminate them. The light may diffuse through one or more suitable layers before illuminating the number keys, such as a mask layer and a keyboard membrane layer.

The light that may be emitted by LED 517 and reflected toward the keys of interest by reflecting plate 518 may be prevented from diffusing towards undesired portions of light guide pipe 500 using any suitable approach. For example, there may be slots 530*a*-530*c*, which may be the same as or different from, and may possess some or all of the features of slots 540*a*-540*c*, that may channel light emitted by LED 517 away from light guide pipe 500 while also reflecting light back towards LED 517. Slots 530*a*-530*c* may be positioned anywhere suitable in light guide pipe 500 to aid LED 517 and reflecting plate 518 in illuminating only the keys of interest. In FIG. 5, slot 530*a* may be positioned to prevent the light emitted by LED 517 and reflected by reflecting plate 518 from diffusing toward a portion of light guide pipe 500 underneath LEDs 502, 504, 506, 507, and 509, for example. Similarly, slot 530*b* may be positioned to prevent the same light from diffusing further along light guide pipe 500 towards right edge 501*r*. Light guide pipe 500 may also include a third slot 530*c* parallel to slot 530*a* to prevent light from diffusing out along top edge 501*t* of light guide pipe 500. Slots 530*a*-530*c* may also reflect light back into the area of light guide pipe 500 bounded by the slots and reflecting plate 518 to enhance the particular illumination of the keys of interest.

Light guide pipe 500 may also provide for the selective or variable illumination of particular keys, without the help of a reflective surface, in any suitable manner. For example, light guide pipe 500 may include LED 511 and LED 512, for emitting light anywhere suitable within light guide pipe 500, to provide key-specific illumination without the aid of a reflecting plate.

LEDs 511 and 512 may be employed to selectively or variably illuminate particular keys of interest using any suitable approach. For example, LED 512 may illuminate the "CAPS LOCK" key on a standard keyboard (e.g., "CAPS LOCK" key 105*d* of keyboard assembly 100 of FIG. 1). LED 512 may be mounted to a flex layer above or below light guide pipe 500, such as flex layer 120 or keyboard membrane layer 150 of FIG. 1, but LED 512 may emit light into light guide pipe 500. For simplicity, LED 512 is described with respect to FIG. 5 as being mounted below light guide pipe 500. Upon receiving an appropriate input, LED 512 may emit light into light guide pipe 500 and toward left edge 501*l* of light guide pipe 500, in a direction generally parallel with axis 550, and underneath the "CAPS LOCK" key. The light emitted by LED 512 may be prevented from diffusing toward undesired portions of light guide pipe 500 using any suitable approach, such as slots 535*a*-535*c*, which may be the same as or different from, and may possess some or all of the features of slots 540*a*-540*c*. Slot 535*a* may be positioned to prevent the light emitted by LED 512 from diffusing toward the portion of light guide pipe 500 with LED 517, for example. Similarly, slot 535*b* may be positioned to prevent the same light from diffusing toward a portion of light guide pipe 500 closer to bottom edge 501*b* of light guide pipe 500. Light guide pipe 500 may also include a third slot 535*c* to prevent light from diffusing out along left edge 501*l* of light guide pipe 500. Slots 535*a*-535*c* may also reflect light back into the area of light guide pipe 500 bounded by the slots to enhance the particular illumination of the key or keys of interest.

Similarly, LED 511 may be mounted to a flex layer above or below light guide pipe 500, such as flex layer 120 or keyboard membrane layer 150 of FIG. 1, but LED 511 may emit light into light guide pipe 500 to illuminate keys of interest, such as the function keys on a standard keyboard (e.g., function keys 105*f* of FIG. 1). For simplicity, LED 511 is described with respect to FIG. 5 as being mounted below light guide pipe 500. Upon receiving an appropriate input, LED 511 may emit light into light guide pipe 500, toward the bottom edge 501*b* and right edge 501*r* of light guide pipe 500, and underneath the keys of interest. Light emitted by LED 511 may diffuse in a direction that forms any suitable angle with axis 550 in the X-Y plane of light guide pipe 500. The light emitted by LED 511 may be prevented from diffusing toward undesired portions of light guide pipe 500 using any suitable approach, such as slots 525*a*-525*d*, which may be the same as or different from, and may possess some or all of the features of slots 540*a*-540*c*. Slot 525*a* may be positioned to prevent the light emitted by LED 511 from diffusing to a portion of light guide pipe 500 closer to left edge 501*l*. Similarly, slot 525*b* may be positioned to prevent the same light from diffusing to a portion of light guide pipe 500 closer to right edge 501*r*. Light guide pipe 500 may also include a third slot, slot 525*c*, that may prevent light from diffusing along light guide pipe 500 toward a portion closer to bottom edge 501*b*, while a fourth slot 525*d* may prevent light from diffusing out of light guide pipe 500 along top edge 501*t*. Slots 525*a*-525*d* may also reflect light back into the area of light guide pipe 500 bounded by the slots to enhance the particular illumination of the key or keys of interest.

In some embodiments, the slots of FIG. 5 may be shaped differently to prevent light from diffusing toward other keys not meant to be selectively or variably illuminated. For example, slots 530*a* and 530*b* may be merged to form one L-shaped slot. Alternatively, slots 525*a*-525*c* may be merged and reshaped to form a U-shaped slot around LED 511.

Figure 5A:
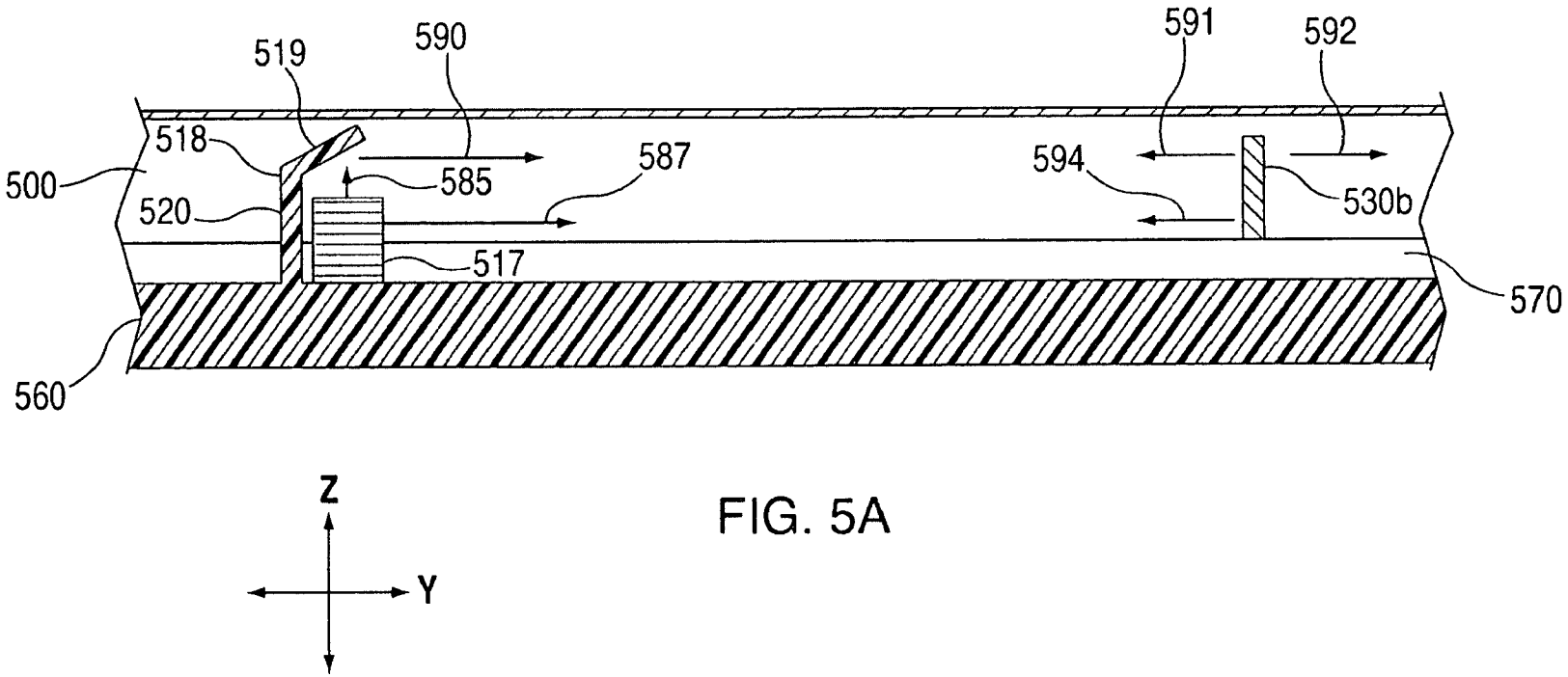
FIG. 5A shows a cross-sectional view of a portion of the keyboard assembly of FIG. 5 in accordance with some embodiments of the invention.

In some embodiments, the reflecting plates of FIG. 5 may include material from another layer of the keyboard assembly, such as a base layer (e.g., base layer 110 of FIGS. 1 and 2 or base layer 310 of FIGS. 3 and 4) that may be bent or otherwise formed into light guide pipe 500 to provide a reflecting surface. FIG. 5A shows a cross-sectional view of a portion of the keyboard assembly including the light guide pipe 500 of FIG. 5. As shown, an illumination source may be reflected using material from a base layer in accordance with some embodiments of the invention. Light guide pipe 500 may be positioned above any suitable layer or layers in a keyboard assembly, such as a reflector sheet 570 and a base layer 560, which may be the same as or different from, and may include some or all of the features of reflector sheet layer 125 and base layer 110, respectively, of FIGS. 1 and 2. For example, reflecting plate 518 may form part of base layer 560 and may include the same material as base layer 560. Reflecting plate 518 may be bent into light guide pipe 500 to provide a reflecting surface for light emitted by LED 517 (FIG. 5).

Reflecting plate 518 may aid LED 517 in providing key-specific illumination using any suitable approach. For example, LED 517 may emit light upwardly into light guide pipe 500 in the direction of arrow 585 towards a top portion 519 of reflecting plate 518. The light may be reflected by reflecting plate 518 in the direction of arrow 590 towards slot 530*b*, thereby diffusing under the key or keys of interest (e.g., number keys 105*n* of FIG. 1). The reflected light may reach slot 530*b* and may be reflected back in the direction of arrow 591 towards reflecting plate 518 to enhance the key-specific illumination provided by LED 517. Slot 530*b* may also prevent the light emitted by LED 517 from diffusing to other portions of light guide pipe 500 beyond slot 530*b* (e.g., in the direction of arrow 592).

In some embodiments, instead of emitting light upwardly in the direction of arrow 585 into light guide pipe 500 (e.g., substantially along the Z-axis), LED 517 may emit light sideways along light guide pipe 500 in any direction in the X-Y plane. Reflecting plate 518 may be positioned anywhere suitable within light guide pipe 500 to reflect the light emitted by LED 517 along the X-Y plane. At least some of the light emitted by LED 517 may be reflected by the side portion 520 of reflecting plate 518 in the direction of arrow 587 towards slot 530*b*, thereby diffusing under the key or keys of interest (e.g., number keys 105*n* of FIG. 1). The reflected light may reach slot 530*b* and may be reflected back in the direction of arrow 594 towards side portion 520 of reflecting plate 518 to enhance the key-specific illumination provided by LED 517. Slot 530*b* may also prevent the light emitted by LED 517 from diffusing to other portions of light guide pipe 500 beyond slot 530*b* (e.g., in the direction of arrow 592).

In some embodiments, LED 517 may emit light upwardly in the direction of arrow 585 (e.g., generally along the Z-axis) while also emitting light sideways along light guide pipe 500 in any direction along the X-Y plane. At least some of the light emitted by LED 517 may be reflected by top portion 519 and at least some of the light emitted by LED 517 may be reflected by side portion 520 of reflecting plate 518 in the direction of arrow 590 and arrow 587, respectively, towards slot 530*b*. The reflected light may reach slot 530*b* and may be reflected back in the direction of arrow 591 and arrow 594, respectively, towards top portion 519 and side portion 520 of reflecting plate 518 to enhance the key-specific illumination provided by LED 517.

Figure 6:
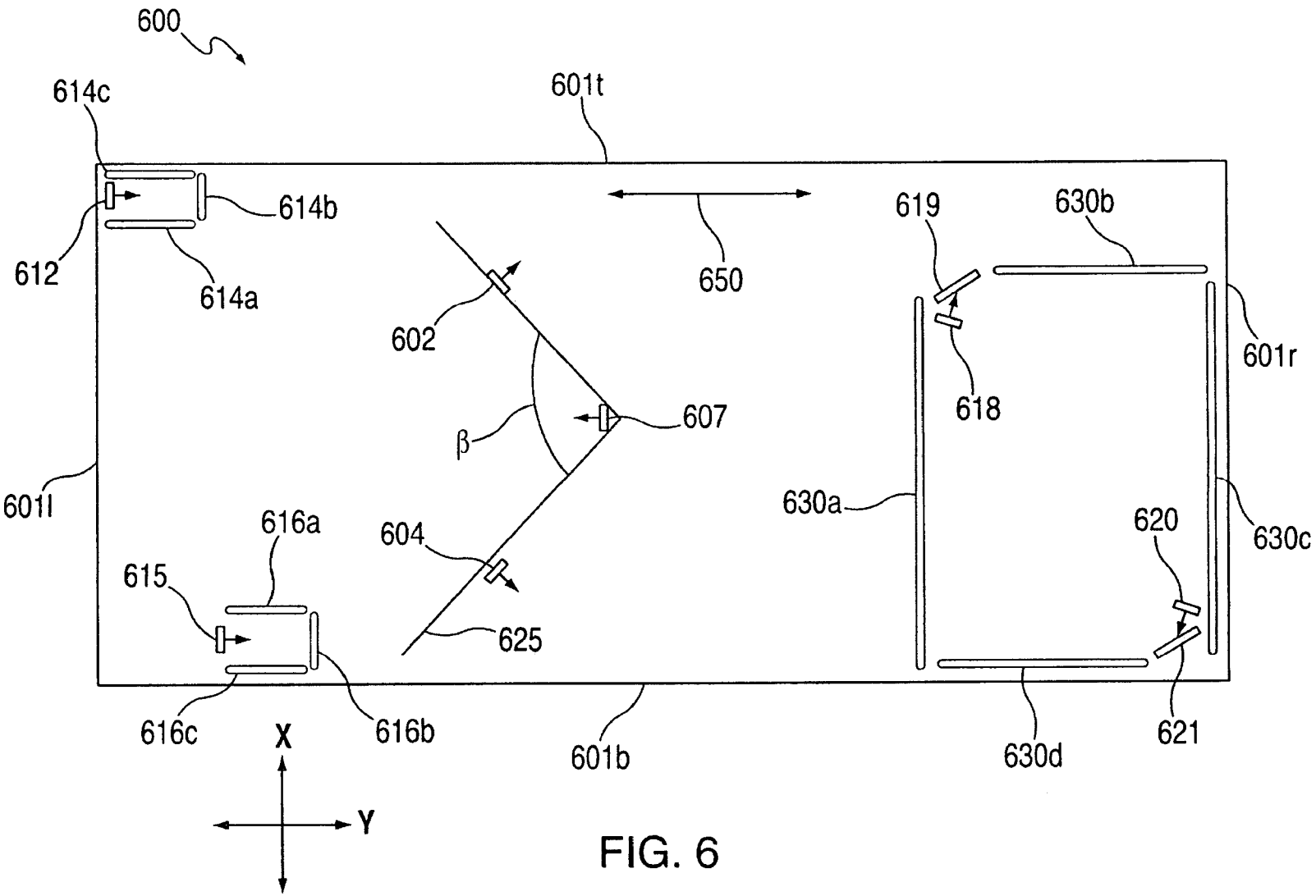
FIG. 6 shows a vertical cross-sectional view of a distribution of illumination sources in a portion of a keyboard assembly in accordance with some embodiments of the invention.

FIG. 6 is a vertical cross-sectional view of a distribution of illumination sources in accordance with some embodiments of the invention. Light guide pipe 600 may provide any suitable arrangement of illumination sources, which may be the same as or different from, and may possess some or all of the features of the illumination sources in FIG. 5, to provide illumination to a keyboard assembly. For example, LED 602 and LED 604 may be positioned on a flex layer (e.g., flex layer 120 of FIG. 1) so that each may emit light towards the middle portion of light guide pipe 600 along an axis that is not parallel to longitudinal axis 650 of light guide pipe 600. LED 607 may be positioned on a flex layer (e.g., flex layer 120 of FIG. 1) so that it may emit light away from the middle portion of light guide pipe 600 along an axis parallel to axis 650. More LEDs may emit light toward the right edge 601*r* of light guide pipe 600 than toward the left edge 601*l* because the right side of the keyboard assembly above light guide pipe 600 may contain more keys than the left side of the keyboard assembly. The close proximity of LEDs 602, 604, and 607 to one another in FIG. 6 may allow a smaller flex layer to be used, thereby lowering the cost and weight of the keyboard assembly. Other LEDs may be mounted to a keyboard membrane, such as keyboard membrane layer 150 of FIGS. 1 and 2, to allow the keyboard assembly to provide key-specific illumination while minimizing the space required for a flex layer to support LEDs 602, 604, and 607.

LEDs 602 and 604 may not face LED 607, and the relative position of each of LEDs 602, 604, and 607, as illustrated by reference line 625, may form an angle β of any suitable value in the X-Y plane of light guide pipe 600. LED 607 may be positioned anywhere suitable between LED 602 and LED 604 with respect to the X-axis so as to emit light in a direction substantially opposite to LEDs 602 and 604, with respect to the Y-axis. The light emitted by the three LEDs may diffuse across the length of light guide pipe 600 to generally illuminate a keyboard. Diffused light may be redirected upwardly towards the keyboard using any suitable method, such as a reflector sheet layer (e.g., reflector sheet layer 125 of FIGS. 1 and 2) underneath light guide pipe 600 to direct the diffused light upwardly through light guide pipe 600, and a mask layer (e.g., mask layer 140 of FIGS. 1 and 2) to channel the diffused light through unmasked portions toward the keys (e.g., through unmasked portions 145 towards keys 105 of FIGS. 1 and 2).

In addition to or as an alternative to the general illumination that may be provided by LEDs 602, 604, and 607, light guide pipe 600 may contain any suitable number of illumination sources to selectively or variably illuminate a keyboard using any suitable approach. For example, light guide pipe 600 may include one or more illumination sources accompanied by a reflective surface for redirecting emitted light towards particular keys of interest. For example, as shown in FIG. 6, LED 618 and LED 620 may be positioned near reflective surfaces, such as reflecting plate 619 and reflecting plate 621, respectively. Reflecting plates 619 and 621 may be the same as or different from, and may include some or all of the features of, reflecting plates 516 and 518 of FIG. 5. Reflecting plates 619 and 621 may be positioned anywhere within light guide pipe 600 to aid LEDs 618 and 620 in selectively or variably illuminating particular keys of interest. In some embodiments, reflecting plates 619 and 621 may be angled to face in any suitable direction other than what is pictured in FIG. 6 to provide illumination to different keys.

LEDs 618 and 620 may be provided with reflecting plates 619 and 621, respectively, to selectively or variably illuminate particular keys of interest using any suitable approach. For example, LEDs 618 and 620 may illuminate the keys that create the number pad of a standard keyboard (e.g., number pad keys 105*p* of keyboard assembly 100 of FIG. 1). LEDs 618 and 620 may be coupled to a flex layer above or below light guide pipe 600, such as flex layer 120 or keyboard membrane layer 150 of FIG. 1, but LEDs 618 and 620 may emit light upwardly into or sideways along light guide pipe 600. For simplicity, LEDs 618 and 620 are described with respect to FIG. 6 as being mounted below light guide pipe 600. Upon receiving an appropriate input, LED 618 may emit light upwardly into or sideways along light guide pipe 600, and reflecting plate 619 may reflect the emitted light towards the bottom edge 601*b* and right edge 601*r* of light guide pipe 600. Likewise, LED 620 may emit light upwardly into or sideways along light guide pipe 600, and reflecting plate 621 may reflect the emitted light toward the top edge 601*t* and left edge 601*l* of light guide pipe 600. The light emitted by LEDs 618 and 620 and reflected by reflecting plates 619 and 621 may diffuse upwardly toward the key or keys of interest (e.g., number pad keys 105*p*) to illuminate them. The light may diffuse through one or more suitable layers, such as a mask layer and a keyboard membrane layer (e.g., mask layer 140 and keyboard membrane layer 150 of FIG. 1), before illuminating the key or keys of interest.

The light that may be emitted by LEDs 618 and 620 and reflected by reflecting plates 619 and 621 may be prevented from diffusing through undesired portions of light guide pipe 600 using any suitable approach. For example, slots 630*a*-630*b*, which may be the same as or different from, and may include some or all of the features of slots 540*a*-540*c* of FIG. 5, may be positioned to prevent the light reflected by reflecting plates 619 and 621 from diffusing beyond the portion of light guide pipe 600 underneath the key or keys of interest. Light guide pipe 600 may also include two additional slots 630*c* and 630*d*, which may be the same as or different from, and may include some or all of the features of slots 540*a*-540*c* of FIG. 5, positioned along the right edge 601*r* and the bottom edge 601*b* of light guide pipe 600, to prevent light from diffusing out beyond light guide pipe 600. Slots 630*a*-630*d* may also reflect light back into the area of light guide pipe 600 bounded by the slots to enhance the particular illumination of the key or keys of interest.

Light guide pipe 600 may also provide for the selective or variable illumination of particular keys, without the help of a reflective surface, in any suitable manner. For example, light guide pipe 600 may include LED 612 and LED 615 for emitting light anywhere suitable within light guide pipe 600, to provide key-specific illumination without the use of a reflecting plate.

LEDs 612 and 615 may be used to selectively or variably illuminate particular keys of interest using any suitable approach. For example, LED 612 may illuminate the "ESCAPE" key on a standard keyboard (e.g., "ESCAPE" key 105*b* of keyboard assembly 100 of FIG. 1). LED 612 may be mounted to a flex layer above or below light guide pipe 600, such as flex layer 120 or keyboard membrane layer 150 of FIG. 1, but LED 612 may emit light into light guide pipe 600. For simplicity, LED 612 is described with respect to FIG. 6 as being mounted below light guide pipe 600. Upon receiving an appropriate input, LED 612 may emit light into light guide pipe 600 toward the right edge 601*r* of light guide pipe 600, in a direction generally parallel with axis 650, and underneath the key of interest. The light emitted by LED 612 may be prevented from diffusing towards undesired portions of light guide pipe 600 using any suitable approach, such as slots 614*a*-614*c*, which may be the same as or different from, and may possess some or all of the features of, slots 540*a*-540*c* of FIG. 5. Slot 614*a* may be positioned to prevent light from diffusing through a portion of light guide pipe 600 closer to bottom edge 601*b*. Similarly, slot 614*b* may be positioned to prevent the same light from diffusing through a portion of light guide pipe 600 closer to right edge 601*r*. Light guide pipe 600 may also include a third slot 614*c* parallel to slot 614*a* to prevent light from diffusing out along top edge 601*t* of light guide pipe 600. Slots 614*a*-614*c* may also reflect light back into the area of light guide pipe 600 bounded by the slots to enhance the particular illumination of the key or keys of interest.

Similarly, LED 615 may be mounted to a flex layer above or below light guide pipe 600, such as flex layer 120 or keyboard membrane layer 150 of FIGS. 1 and 2, but LED 615 may emit light into light guide pipe 600 to illuminate the "ALT" or "COMMAND" key on a standard keyboard, such as "COMMAND" key 105*r* of keyboard assembly 100 of FIG. 1. For simplicity, LED 615 is described with respect to FIG. 6 as being mounted below light guide pipe 600. Upon receiving an appropriate input, LED 615 may emit light into light guide pipe 600 and towards right edge 601*r* of light guide pipe 600, in a direction generally parallel with axis 650, and underneath the key of interest. The light that may be emitted by LED 615 may be prevented from diffusing through undesired portions of light guide pipe 600 using any suitable approach, such as slots 616*a*-616*c*, which may be the same as or different from, and may possess some or all of the features of, slots 540*a*-540*c* of FIG. 5. Slot 616*a* may be positioned to prevent light from diffusing to a portion of light guide pipe 600 closer to top edge 601*t*. Similarly, slot 616*b* may be positioned to prevent the same light from diffusing to the portion of light guide pipe 600 closer to right edge 601*r*. Light guide pipe 600 may also include a third slot 616*c* parallel to slot 616*a* to prevent light from diffusing out along bottom edge 601*b* of light guide pipe 600. Slots 616*a*-616*c* may also reflect light back into the area of light guide pipe 600 bounded by the slots to enhance the particular illumination of the one or more keys of interest.

Figure 7:
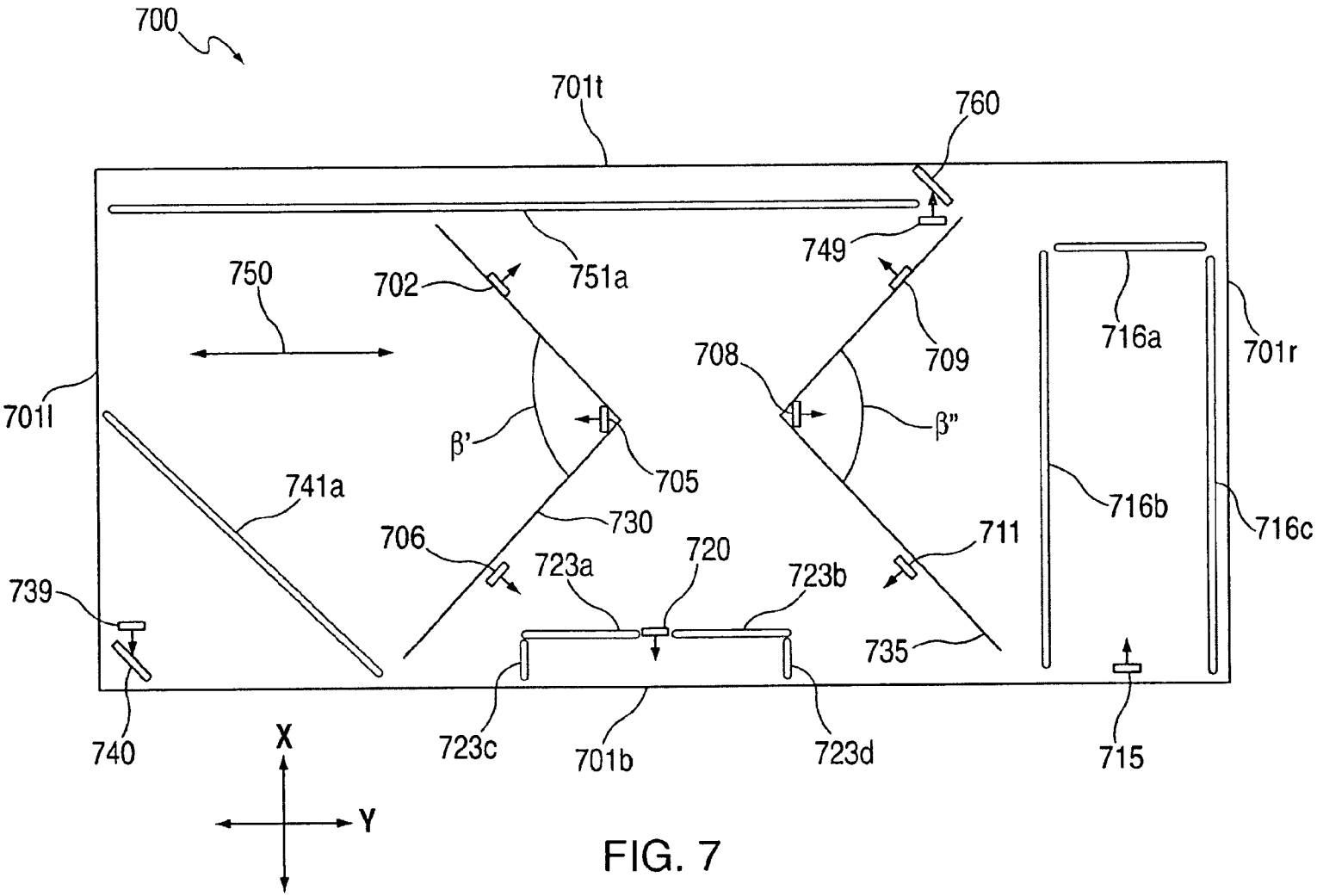
FIG. 7 shows a vertical cross-sectional view of a distribution of illumination sources in a portion of a keyboard assembly in accordance with some embodiments of the invention.

FIG. 7 is a vertical cross-sectional view of a distribution of illumination sources in accordance with some embodiments of the invention. Light guide pipe 700 may provide for any suitable arrangement of illumination sources, which may be the same as or different from, and may include some or all of the features of, the illumination sources in FIG. 5, to illuminate a keyboard. For example, LEDs 702, 706, 709, and 711 may each be positioned on a flex layer (e.g., flex layer 120 of FIG. 1) so that each may emit light towards the middle portion of light guide pipe 700 but along an axis that is not parallel to longitudinal axis 750. LEDs 705 and 708 may be positioned on a flex layer so that each may emit light away from the middle portion of light guide pipe 700 along an axis parallel to axis 750.

Although there may be an even number of general illumination sources, the illumination sources may not be facing one another, nor may they be facing all in the same direction. The relative position of each of LEDs 702, 705, and 706, as shown by reference line 730, may form an angle β' of any suitable value that may be equal to, less than, or greater than an angle β" formed by the relative position of each of LEDs 709, 708, and 711, as shown by reference line 735. LED 705 may be positioned anywhere suitable between LED 702 and LED 706 with respect to the X-axis so as to emit light in a direction generally opposite to LEDs 702 and 706 with respect to the Y-axis and that may serve to illuminate the left portion of a keyboard. Similarly, LED 708 may be positioned anywhere suitable between LED 709 and LED 711 with respect to the X-axis so as to emit light in a direction generally opposite to LEDs 709 and 711 with respect to the Y-axis and that may serve to illuminate the right portion of a keyboard. The light emitted by these six LEDs may diffuse across the length of light guide pipe 700 (in the X-Y plane) to generally illuminate a keyboard. Diffused light may be redirected upwardly towards the keyboard using any suitable method, such as a reflector sheet layer (e.g., reflector sheet layer 125 of FIGS. 1 and 2) underneath light guide pipe 700 to direct the diffused light upwardly through light guide pipe 700 and a mask layer (e.g., mask layer 140 of FIGS. 1 and 2) to channel the diffused light towards the keys (e.g., keys 105 of FIGS. 1 and 2).

In addition to or as an alternative to the general illumination that may be provided by LEDs 702, 705, 706, 708, 709, and 711, light guide pipe 700 may contain any suitable number of illumination sources to selectively or variably illuminate a keyboard using any suitable approach. For example, light guide pipe 700 may include one or more illumination sources accompanied by a reflective surface for redirecting emitted light towards a particular key or keys of interest. For example, as shown in FIG. 7, LED 739 and LED 749 may be provided within light guide pipe 700 near reflecting plate 740 and reflecting plate 760, respectively. Reflecting plates 740 and 760 may be the same as or different from, and may include some or all of the features of, reflecting plates 516 and 518 of FIG. 5. Reflecting plates 740 and 760 may be positioned anywhere within light guide pipe 700 to aid LEDs 739 and 749 in selectively or variably illuminating particular keys of interest. In some embodiments, reflecting plates 740 and 760 may be angled to face in any suitable direction other than what is pictured in FIG. 7 to provide illumination to different keys.

LEDs 739 and 749 may be employed with reflecting plates 740 and 760, respectively, to selectively or variably illuminate particular keys of interest using any suitable approach. For example, LED 739 may illuminate the "function" keys in the lower left corner (e.g., the "CAPS LOCK" key, the "SHIFT" key, the "CTRL" key, etc.) of a standard keyboard, such as keys 105*d*, 105*t*, 105*m* and 105*r* of keyboard assembly 100 of FIG. 1. LED 739 may be coupled to a flex layer above or below light guide pipe 700, such as flex layer 120 or keyboard membrane layer 150 of FIG. 1, but LED 739 may emit light upwardly into or sideways along light guide pipe 700. For simplicity, LED 739 is described with respect to FIG. 7 as being mounted below light guide pipe 700. Upon receiving an appropriate input, LED 739 may emit light upwardly into or sideways along light guide pipe 700 and reflecting plate 740 may reflect the emitted light toward the top edge 701*t* and right edge 701*r* of light guide pipe 700 and underneath the key or keys of interest.

Likewise, LED 749 may illuminate a row of number keys on a standard keyboard, such as number keys 105*n* of keyboard assembly 100 of FIG. 1. LED 749 may be mounted below light guide pipe 700, similar to LED 739. For simplicity, LED 749 is described with respect to FIG. 7 as being mounted below light guide pipe 700. Upon receiving an appropriate input, LED 749 may emit light upwardly into or sideways along light guide pipe 700, and reflecting plate 760 may reflect the emitted light generally towards left edge 701*l* of light guide pipe 700, in a direction generally parallel with longitudinal axis 750, and underneath the row of number keys 105*n*. The emitted and reflected light from these LEDs may diffuse upwardly towards the particular keys of interest to illuminate them. The light of LEDs 739 and 749 may diffuse through one or more suitable layers before illuminating the keys of interest, such as a mask layer and a keyboard membrane layer (e.g., mask layer 140 and keyboard membrane layer 150 of FIG. 1).

The light that may be reflected by reflecting plates 740 and 760 may be prevented from diffusing through undesired portions of light guide pipe 700 using any suitable approach. For example, slots 741*a* and 751*a* may be the same as or different from, and may include some or all of the features of, slots 540*a*-540*c* of FIG. 5. Slots 741*a* and 751*a* may each be positioned in light guide pipe 700 to prevent the light reflected by reflecting plates 740 and 760 from diffusing into the portion of light guide pipe 700 underneath keys that are not of interest. Light guide pipe 700 may also include additional slots (not shown) positioned along left edge 701*l* and bottom edge 701*b* of light guide pipe 700 to prevent light from LEDs 739 from diffusing out beyond those edges, for example. Slots 741*a* and 751*a* may each reflect light back into the area of light guide pipe 700 bounded by the respective slots to enhance the particular illumination of the keys of interest.

Light guide pipe 700 may also provide for the selective or variable illumination of particular keys, without the help of a reflective surface, in any suitable manner. For example, light guide pipe 700 may include LED 715 and LED 720, emitting light anywhere suitable within light guide pipe 700, to provide key-specific illumination without the aid of a reflecting plate.

LEDs 715 and 720 may be employed to selectively or variably illuminate particular keys of interest using any suitable approach. For example, LED 715 may illuminate the number pad on a standard keyboard, such as number pad keys 105*p* of keyboard assembly 100 of FIG. 1. LED 715 may be mounted to a flex layer above or below light guide pipe 700, such as flex layer 120 or keyboard membrane layer 150 of FIG. 1, but LED 715 may emit light into light guide pipe 700. For simplicity, LED 715 is described with respect to FIG. 7 as being mounted below light guide pipe 700. Upon receiving an appropriate input, LED 715 may emit light into light guide pipe 700 and toward top edge 701*t* of light guide pipe 700, in a direction generally perpendicular to axis 750, and underneath the keys of interest. The light emitted by LED 715 may be prevented from diffusing through undesired portions of light guide pipe 700 using any suitable approach, such as slots 716*a*-716*c*, which may be the same as or different from, and may possess some or all of the features of slots 540*a*-540*c* of FIG. 5. Slots 716*a* and 716*b* may be positioned to prevent light from diffusing beyond the portion of light guide pipe 700 underneath the keys of interest (e.g., number pad keys 105*p* of FIG. 1). Slot 716*c* may be parallel to slot 716*b* and may prevent light from diffusing out along right edge 701*r* of light guide pipe 700, for example. Slots 716*a*-716*c* may also reflect light back into the area of light guide pipe 700 bounded by these slots and bottom edge 701*b* of light guide pipe 700 to enhance the particular illumination of the keys of interest.

Similarly, LED 720 may be mounted to a flex layer above or below light guide pipe 700, such as flex layer 120 or keyboard membrane layer 150 of FIGS. 1 and 2, but LED 720 may emit light through light guide pipe 700 to illuminate the "SPACEBAR" key on a standard keyboard, such as the "SPACEBAR" key 105*s* of keyboard assembly 100 of FIG. 1. For simplicity, LED 720 is described with respect to FIG. 7 as being mounted below light guide pipe 700. Upon receiving an appropriate input, LED 720 may emit light into light guide pipe 700 and towards bottom edge 701*b* of light guide pipe 700, in a direction generally perpendicular to axis 750, and underneath the keys of interest (e.g., key 105*s*). The light that may be emitted by LED 720 may be prevented from diffusing through undesired portions of light guide pipe 700 using any suitable approach, such as slots 723*a*-723*d*, which may be the same as or different from, and may possess some or all of the features of, slots 540*a*-540*c* of FIG. 5. Each of the slots may be positioned to prevent light from diffusing beyond the portion of light guide pipe 700 underneath the key of interest. Light guide pipe 700 may also include a fifth slot (not shown) to prevent light from diffusing out along bottom edge 701*b* of light guide pipe 700. Slots 723*a*-723*d* may also reflect light back into the area of light guide pipe 700 bounded by the slots and bottom edge 701*b* of light guide pipe 700 to enhance the particular illumination of the key of interest (e.g., "SPACEBAR" key 105*s* of FIG. 1).

Figure 8:
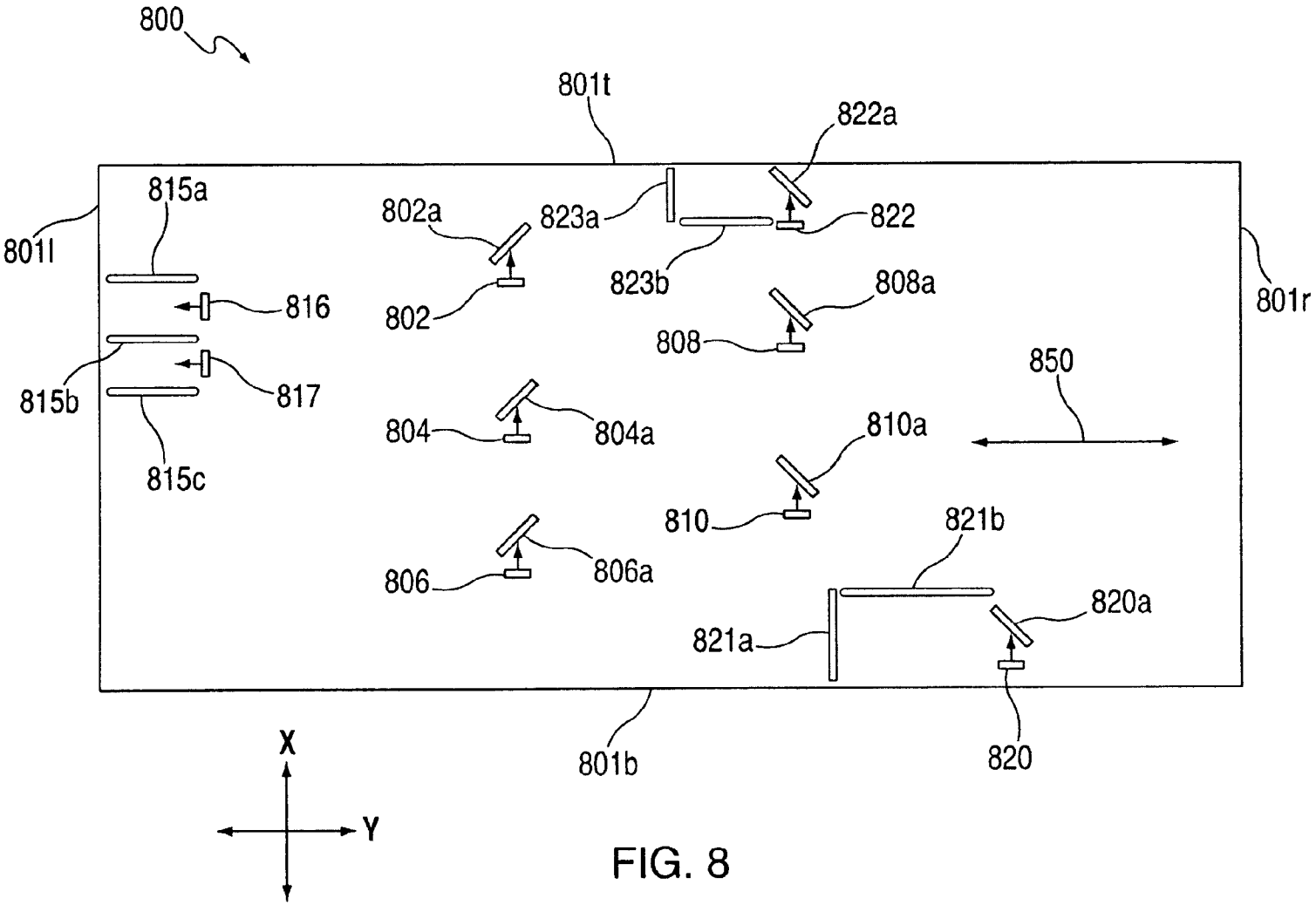
FIG. 8 shows a vertical cross-sectional view of a distribution of illumination sources in a portion of a keyboard assembly in accordance with some embodiments of the invention.

FIG. 8 is a vertical cross-sectional view of a distribution of illumination sources in accordance with some embodiments of the invention. Light guide pipe 800 may provide for any suitable arrangement of illumination sources, which may be the same as or different from, and may include some or all of the features of the illumination sources in FIG. 5, to illuminate a keyboard. For example, each of LEDs 802, 804, 806, 808, and 810 may be positioned on a flex layer (e.g., flex layer 120 of FIGS. 1 and 2) so that each may emit light in the same direction as each of the other LEDs upwardly into or sideways along light guide pipe 800 along an axis that may form any suitable angle with longitudinal axis 850.

The light emitted by each of LEDs 802, 804, 806, 808, and 810 may be redirected to generally illuminate a keyboard using any suitable approach. For example, LEDs 802, 804, 806, 808, and 810 may each be positioned on a flex layer (e.g., flex layer 120 of FIG. 1) to emit light upwardly into or sideways along light guide pipe 800 toward reflecting plates 802*a*, 804*a*, 806*a*, 808*a*, and 810*a*, respectively. Reflecting plates 802*a*, 804*a*, 806*a*, 808*a*, and 810*a* may be the same as or different from, and may include some or all of the features of reflecting plates 516 and 518 of FIG. 5, for example. Light emitted from LEDs 808 and 810 may be reflected toward the middle portion of light guide pipe 800 using reflective plates 808*a* and 810*a*, respectively, while the light emitted by LEDs 802, 804, and 806 may be reflected by reflecting plates 802*a*, 804*a*, and 806*a* towards the middle portion of light guide pipe 800. However the light reflected by reflective plates 808*a* and 810*a* may diffuse in a direction generally opposite that of the light reflected by reflective plates 802*a*, 804*a*, and 806*a*.

None of these LEDs may directly face another LED in some embodiments. Reflecting plate 808*a* may be positioned anywhere suitable between reflecting plates 802*a* and 804*a* with respect to the X-axis so as to redirect light in a direction opposite to, but without overlapping entirely, the light reflected by reflecting plates 802*a* and 804*a*, respectively, with respect to the Y-axis. Similarly, reflecting plate 810*a* may be positioned anywhere suitable between reflecting plates 804*a* and 806*a* with respect to the X-axis so as to redirect light in a direction opposite to, but without overlapping entirely, the light reflected by reflecting plates 804*a* and 806*a*, respectively, with respect to the Y-axis. Because the diffused light may not substantially overlap, light reflected by these reflecting plates may diffuse uniformly across the X-Y plane of light guide pipe 800 to generally illuminate a keyboard. Diffused light may be redirected upwardly towards the keyboard using any suitable method, such as a reflector sheet layer (e.g., reflector sheet layer 125 of FIGS. 1 and 2) underneath light guide pipe 800 to direct the emitted light up through light guide pipe 800 and a mask layer (e.g., mask layer 140 of FIGS. 1 and 2) to channel the diffused light toward the keys (e.g. keys 105 of FIG. 1).

In addition to or as an alternative to the general illumination that may be provided by LEDs 802, 804, 806, 808, and 810, light guide pipe 800 may contain any suitable number of illumination sources to selectively or variably illuminate a keyboard using any suitable approach. For example, light guide pipe 800 may include additional illumination sources accompanied by a reflective surface for redirecting emitted light towards particular keys of interest. In FIG. 8, LED 820 and LED 822 may be provided within light guide pipe 800 near reflecting plate 820*a* and reflecting plate 822*a*, respectively. Reflecting plates 820*a* and 822*a* may be the same as or different from, and may include some or all of the features of, reflecting plates 516 and 518 of FIG. 5, for example. Reflecting plates 820*a* and 822*a* may be positioned anywhere within light guide pipe 800 to aid LEDs 820 and 822 in selectively or variably illuminating particular keys of interest. In some embodiments, reflecting plates 820*a* and 822*a* may be angled to face in any suitable direction other than what is pictured in FIG. 8 to provide illumination to different keys.

LEDs 820 and 822 may be used with reflecting plates 820*a* and 822*a*, respectively, to selectively or variably illuminate particular keys of interest using any suitable approach. For example, similar to LEDs 802, 804, 806, 808 and 810, both LEDs 820 and 822 may be positioned on a flex layer (e.g., flex layer 120 of FIGS. 1 and 2). LED 820 may illuminate the arrow keys of a standard keyboard, such as arrow keys 105*w* of keyboard assembly 100 of FIG. 1. Upon receiving an appropriate input, LED 820 may emit light upwardly into or sideways along light guide pipe 800 and reflecting plate 820*a* may reflect the emitted light in a direction generally parallel with longitudinal axis 850 towards left edge 801*l* of light guide pipe 800, and under the key or keys of interest (e.g., arrow keys 105*w* of FIG. 1).

Likewise, LED 822 may illuminate the "ZERO" number key on a standard keyboard, such as "ZERO" key 105*z* of keyboard assembly 100 of FIG. 1, for example. Upon receiving an appropriate input, LED 822 may emit light upwardly into or sideways along light guide pipe 800, and reflecting plate 822*a* may reflect the emitted light in a direction generally parallel with axis 850 toward left edge 801*l* of light guide pipe 800, and under the key of interest (e.g., "ZERO" key 105*z*). The emitted and reflected light from LEDs 820 and 822 may diffuse upwardly towards the particular keys of interest to illuminate them. The light of LEDs 820 and 822 may diffuse through one or more suitable layers of the keyboard assembly before illuminating the keys of interest, such as a mask layer and a keyboard membrane layer (e.g., mask layer 140 and keyboard membrane layer 150 of FIGS. 1 and 2).

The light that may be reflected by reflecting plates 820*a* and 822*a* may be prevented from diffusing through undesired portions of light guide pipe 800 using any suitable approach. For example, slots 821*a*, 821*b*, 823*a*, and 823*b* may be the same as or different from, and may include some or all of the features of, slots 540*a*-540*c* of FIG. 5. Slots 821*a* and 821*b* may be positioned in light guide pipe 800 to prevent the light reflected by reflecting plate 820*a* from diffusing beyond the portion of light guide pipe 800 underneath the keys of interest (e.g., arrow keys 105*w*). Slots 823*a* and 823*b* may be positioned in light guide pipe 800 to prevent the light reflected by reflecting plate 822*a* from diffusing beyond the portion of light guide pipe 800 underneath the key of interest (e.g., "ZERO" key 105*z*). Light guide pipe 800 may also include additional slots (not shown) positioned along bottom edge 801*b* and top edge 801*t* of light guide pipe 800 to prevent light from LEDs 820 and 822, respectively, from diffusing out beyond those edges. Slots 821*a*, 821*b*, 823*a*, and 823*b* may each reflect light back into the area of light guide pipe 800 bounded by the respective slots to enhance the particular illumination of keys of interest.

In some embodiments, it may be desirable to selectively or variably illuminate one half of a keyboard (e.g., for using the left letter keys to control a video game on an externally coupled computer). LEDs 820 and 822 may not be accompanied by any slots to channel away light, because the emitted light may be desirable under numerous keys and not just the mentioned keys of interest.

Light guide pipe 800 may also provide for the selective or variable illumination of particular keys, without the help of a reflective surface, in any suitable manner. For example, light guide pipe 800 may include LED 816 and LED 817, for emitting light anywhere suitable within light guide pipe 800, to provide key-specific illumination without the aid of a reflecting plate.

LEDs 816 and 817 may be used to selectively or variably illuminate particular keys of interest using any suitable approach. For example, LED 816 may illuminate the "TAB" key on a standard keyboard, such as "TAB" key 105*c* of keyboard assembly 100 of FIG. 1. LED 816 may be mounted to a flex layer above or below light guide pipe 800, such as flex layer 120 or keyboard membrane layer 150 of FIG. 1, but LED 816 may emit light into light guide pipe 800. For simplicity, LED 816 is described with respect to FIG. 8 as being mounted below light guide pipe 800. Upon receiving an appropriate input, LED 816 may emit light into light guide pipe 800 and toward left edge 801*l* of light guide pipe 800, in a direction generally parallel with axis 850, and underneath the key of interest (e.g., "TAB" key 105*c*). The light emitted by LED 816 may be prevented from diffusing through undesired portions of light guide pipe 800 using any suitable approach, such as slots 815*a* and 815*b*, which may be the same as or different from, and may possess some or all of the features of, slots 540*a*-540*c* of FIG. 5. Slots 815*a* and 815*b* may be positioned to prevent light from diffusing beyond the portion of light guide pipe 800 underneath the key of interest. Light guide pipe 800 may also include a third slot (not shown) perpendicular to slots 815*a* and 815*b* to prevent light from diffusing out along left edge 801*l* of light guide pipe 800. Slots 815*a* and 815*b* may also reflect light back into the area of light guide pipe 800 bounded by the two slots and left edge 801*l* of light guide pipe 800 to enhance the particular illumination of the key of interest (e.g., "TAB" key 105*c*).

Similarly, LED 817 may emit light into light guide pipe 800 to illuminate the "CAPS LOCK" key on a standard keyboard, such as "CAPS LOCK" key 105*d* of keyboard assembly 100 of FIG. 1. For simplicity, LED 817 is described with respect to FIG. 8 as being mounted below light guide pipe 800. Slot 815*b* and slot 815*c*, which may be the same as, or different from, and may include some or all of the features of, slots 535*a*-535*c* of FIG. 5, may be positioned to prevent light from diffusing beyond the portion of light guide pipe 800 underneath the key of interest. Light guide pipe 800 may also include a third slot (not shown) perpendicular to slots 815*b* and 815*c* to prevent light from diffusing out along left edge 801*l* of light guide pipe 800. Slots 815*b* and 815*c* may also reflect light back into the area of light guide pipe 800 bounded by the slots and left edge 801*l* to enhance the particular illumination of the key of interest (e.g., "CAPS LOCK" key 105*d*).

Figure 9:
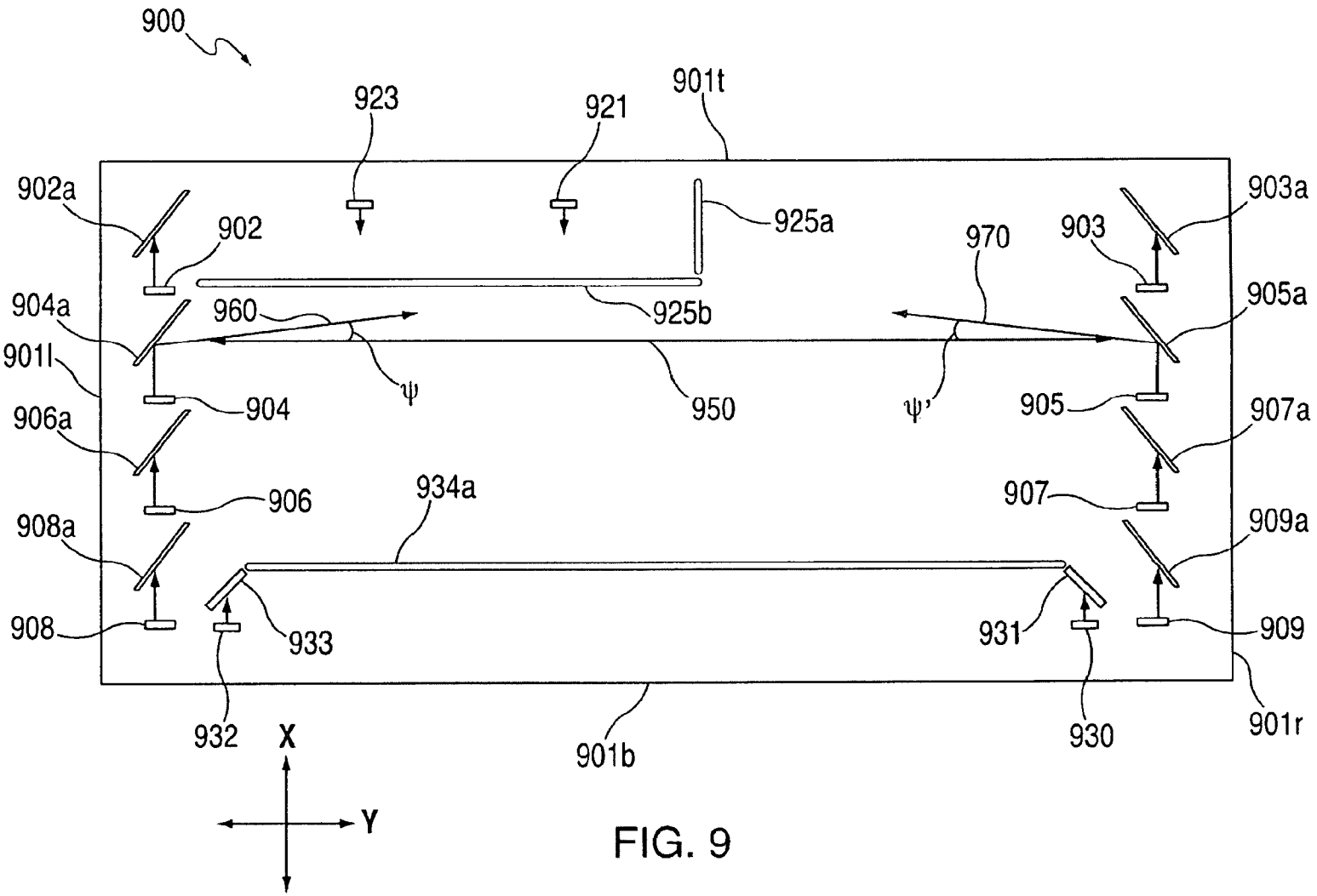
FIG. 9 shows a vertical cross-sectional view of a distribution of illumination sources in a portion of a keyboard assembly in accordance with some embodiments of the invention.

FIG. 9 is a vertical cross-sectional view of a distribution of illumination sources in accordance with some embodiments of the invention. Light guide pipe 900 may provide for any suitable arrangement of illumination sources, which may be the same as or different from, and may include some or all of the features of, the illumination sources in FIG. 5, to illuminate a keyboard. For example, each of LEDs 902, 903, 904, 905, 906, 907, 908, and 909 may be positioned on any suitable layer, such as flex layer 120 or keyboard membrane layer 150 of FIG. 1, to receive power while emitting light through light guide pipe 900. For simplicity, each of LEDs 902, 903, 904, 905, 906, 907, 908 and 909 is described with respect to FIG. 9 as being mounted below light guide pipe 900. The light emitted by each of these LEDs, when reflected toward the middle portion of light guide pipe 900, may form any suitable angle of intersection with longitudinal axis 950.

The light emitted by each LED may be redirected toward the middle portion of light guide pipe 900 to generally illuminate a keyboard using any suitable approach. For example, LEDs 902, 903, 904, 905, 906, 907, 908, and 909 each may emit light upwardly into light guide pipe 900 (e.g., upwardly out of the drawing sheet containing FIG. 9 along the Z-axis (not shown)), or each may emit light sideways along light guide pipe 900 generally along the X-Y plane. The light emitted by each of these LEDs may diffuse toward its respective reflecting surface 902*a*, 903*a*, 904*a*, 905*a*, 906*a*, 907*a*, 908*a*, and 909*a*. Reflecting plates 902*a*, 903*a*, 904*a*, 905*a*, 906*a*, 907*a*, 908*a*, and 909*a* may be the same as or different from, and may include some or all of the features of, reflecting plates 516 and 518 of FIGS. 5 and 5A. For example, if light is emitted from LED 904 upwardly into light guide pipe 900, or emitted sideways along light guide pipe 900, then the light may be reflected by reflecting surface 904*a* toward the middle portion of light guide pipe 900 along a path 960, which may form any suitable angle Ψ with axis 950. Similarly, light that may be emitted from LED 905 upwardly into light guide pipe 900 or emitted sideways along light guide pipe 900 may be reflected by reflecting surface 905*a* toward the middle portion of light guide pipe 900 along a path 970, which may form any suitable angle Ψ' with axis 950.

Light emitted from LEDs 902, 904, 906, and 908 may be reflected toward the middle portion of light guide pipe 900. The reflected light may intersect with light emitted from LEDs 903, 905, 907, and 909, the intersection of which may form an angle of any suitable value. For example, the light emitted by LED 904 and reflected by reflecting plate 904*a* may intersect the light emitted by LED 905 and reflected by reflecting plate 905*a* at an angle (180°−Ψ−Ψ'). None of the LEDs may face another LED in some embodiments. The light emitted by these LEDs may diffuse across the X-Y plane of light guide pipe 900 to generally illuminate a keyboard. Diffused light may be redirected upwardly towards the keyboard using any suitable method, such as a reflector sheet layer (e.g., reflector sheet layer 125 of FIGS. 1 and 2) underneath light guide pipe 900 to direct the diffused light up through light guide pipe 900 and a mask layer (e.g., mask layer 140 of FIGS. 1 and 2) to channel the diffused light through unmasked portions (e.g., unmasked portions 145 of FIG. 1) toward the keys (e.g., keys 105 of FIG. 1).

In addition to or as an alternative to the general illumination that may be provided by LEDs 902, 903, 904, 905, 906, 907, 908, and 909, light guide pipe 900 may include any suitable number of illumination sources to selectively or variably illuminate a keyboard using any suitable approach. For example, light guide pipe 900 may include one or more illumination sources accompanied by a reflective surface for redirecting emitted light towards only a particular key or keys of interest. In FIG. 9, LED 930 and LED 932 may be provided within light guide pipe 900 near reflecting plate 931 and reflecting plate 933, respectively. Reflecting plates 931 and 933 may be the same as or different from, and may include some or all of the features of, reflecting plates 516 and 518 of FIGS. 5 and 5A, for example. Reflecting plates 931 and 933 may be positioned anywhere within light guide pipe 900 to aid LEDs 930 and 932 in selectively or variably illuminating particular keys of interest. In some embodiments, reflecting plates 931 and 933 may be angled to face in any suitable direction other than what is shown in FIG. 9 to provide illumination to different keys.

LEDs 930 and 932 may be employed with reflecting plates 931 and 933, respectively, to selectively or variably illuminate particular keys of interest using any suitable approach. For example, LEDs 930 and 932 may illuminate the bottom row of keys of a standard keyboard, such as the bottom row of keys 105 of keyboard assembly 100 of FIG. 1. LEDs 930 and 932 may be coupled to a flex layer above or below light guide pipe 900, such as flex layer 120 or keyboard membrane layer 150 of FIG. 1, but LEDs 930 and 932 may emit light upwardly into or sideways along light guide pipe 900. For simplicity, LEDs 930 and 932 are described with respect to FIG. 9 as being mounted below light guide pipe 900. Upon receiving an appropriate input, LED 930 may emit light upwardly into or sideways along light guide pipe 900 and reflecting plate 931 may reflect the emitted light in a direction generally parallel with axis 950 and toward left edge 901*l* of light guide pipe 900. Likewise, LED 932 may emit light upwardly into or sideways along light guide pipe 900 and reflecting plate 933 may reflect the emitted light in a direction generally parallel with axis 950 and toward right edge 901*r* of light guide pipe 900. The light may diffuse through one or more suitable layers of the keyboard assembly before illuminating the keys of interest, such as a mask layer and a keyboard membrane layer (e.g., mask layer 140 and keyboard membrane layer 150 of FIGS. 1 and 2).

The light that may be reflected by reflecting plates 931 and 933 may be prevented from diffusing through undesired portions of light guide pipe 900 using any suitable approach. For example, slot 934*a*, which may be the same as or different from, and may include some or all of the features of, slot 540*a* of FIG. 5, may be positioned to prevent the light reflected by reflecting plates 931 and 933 from diffusing into a portion of light guide pipe 900 closer to top edge 901*t* of light guide pipe 900. Light guide pipe 900 may also include an additional slot (not shown) positioned along bottom edge 901*b* of light guide pipe 900 to prevent light from diffusing out beyond that edge of light guide pipe 900. Slot 934*a* may also reflect light back into the area of light guide pipe 900 bounded by it and bottom edge 901*b* of light guide pipe 900 to enhance the particular illumination of the keys of interest (e.g., bottom row of keys 105*o* of FIG. 1).

Light guide pipe 900 may also provide for the selective or variable illumination of particular keys, without the help of a reflective surface, in any suitable manner. For example, light guide pipe 900 may include LED 921 and LED 923, for emitting light anywhere suitable within light guide pipe 900, to provide key-specific illumination without the aid of a reflecting plate.

LEDs 921 and 923 may be used to selectively or variably illuminate particular keys of interest using any suitable approach. For example, LEDs 921 and 923 may illuminate the number keys along the top edge of a standard keyboard, such as number keys 105*n* of keyboard assembly 100 of FIG. 1. LEDs 921 and 923 may be mounted to a flex layer above or below light guide pipe 900, such as flex layer 120 or keyboard membrane layer 150 of FIG. 1, but LEDs 921 and 923 may emit light through light guide pipe 900. For simplicity, LEDs 921 and 923 are described with respect to FIG. 9 as being mounted below light guide pipe 900. Upon receiving an appropriate input, LEDs 921 and 923 may each emit light into light guide pipe 900 and toward bottom edge 901*b* of light guide pipe 900, in a direction generally perpendicular to axis 950, and underneath the keys of interest. The light emitted by LEDs 921 and 923 may be prevented from diffusing through undesired portions of light guide pipe 900 using any suitable approach, such as slots 925*a* and 925*b*, which may be the same as or different from, and may possess some or all of the features of, slots 530*a* and 530*b* of FIG. 5, for example. Slot 925*a* may be positioned to prevent the light emitted by LEDs 921 and 923 from diffusing through a portion of light guide pipe 900 closer to right edge 901*r* of light guide pipe 900. Similarly, slot 925*b* may be positioned to prevent the same light from diffusing through a portion of light guide pipe 900 closer to bottom edge 901*b*. Light guide pipe 900 may also include a third slot (not shown) perpendicular to and to the left of slot 925*b* to prevent light from diffusing out along left edge 901*l* of light guide pipe 900. Slots 925*a* and 925*b* may also reflect light back into the area of light guide pipe 900 bounded by the slots and left edge 901*l* of light guide pipe 900 to enhance the particular illumination of the keys of interest (e.g., number keys 105*n* of FIG. 1).

In some embodiments, light guide pipe 900 may generally illuminate a keyboard by positioning LEDs only along one edge of light guide pipe 900 (e.g., LEDs 902, 904, 906 and 908 may be retained along left edge 901*l* and LEDs 903, 905, 907, or 909 may be removed from right edge 901*r*). Alternatively, LEDs 902, 903, 904, 905, 906, 907, 908, and/or 909 may be moved closer to the middle portion of a flex layer (e.g., flex layer 120 of FIG. 1) so that they emit light closer to the middle portion of light guide pipe 900. In some embodiments, any suitable coating, such as a reflective paint or an opaque but internally bright coating, may be applied to light guide pipe 900 in those regions of light guide pipe 900 where light emitted by the LEDs is not as bright. Application of the coating may improve the uniformity of general illumination provided by the LEDs.

Figure 10:
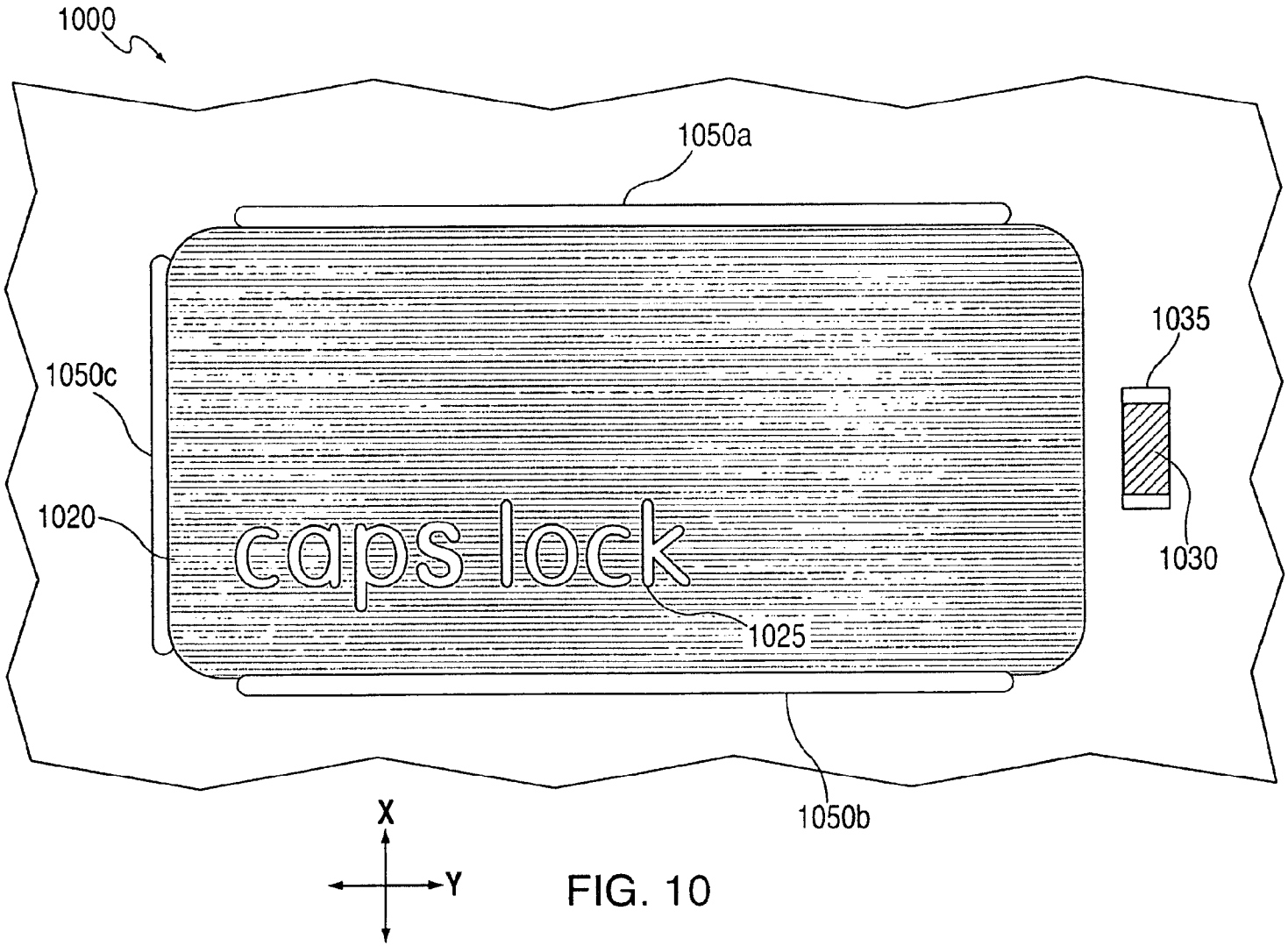
FIG. 10 shows a top view of a distribution of illumination sources in a portion of a keyboard assembly in accordance with some embodiments of the invention.

A layer within a keyboard, such as a light guide pipe, may permit the diffusion of light to provide key-specific illumination to any suitable number of keys. FIG. 10 shows a top view of an illumination of one key of a keyboard assembly in accordance with some embodiments of the invention. Layer 1000 may be a light guide pipe that may be the same as or different from, and may contain some or all of the features of, light guide pipe layer 130 of FIG. 1 or light guide pipe layer 330 of FIG. 3, for example.

Light guide pipe 1000 may include any suitable number of slots, such as slots 1050*a*-1050*c*, which may be the same as, or different from, and may include some or all of the features of, slots 540*a*-540*c* of FIG. 5, for example. Light guide pipe 1000 may also include any suitable number of holes, such as hole 1035 (which may be the same as, and may contain some or all of the features of holes 131*a*, 131*d*, 131*f*, 131*k*, 131*n* and 131*s* of FIG. 1) to permit illumination sources coupled to other layers within a keyboard assembly to at least partially traverse those layers and to emit light into light guide pipe 1000. For example, illumination source 1030, which may be the same as or different from, and may include some or all of the features of, the illumination sources described in FIGS. 5-9, may be mounted to any suitable layer, such as a flex layer or a keyboard membrane layer (e.g. flex layer 120 or keyboard membrane layer 150 of FIG. 1). For simplicity, illumination source 1030 may be described in FIGS. 10-12 as being mounted to a keyboard membrane such as keyboard membrane layer 150, while emerging into light guide pipe 1000 through hole 1035 to emit key-specific light. Also positioned in any suitable layer above light guide pipe 1000 may be a layer including any suitable number of keys, such as key 1020 with an unique legend 1025. Key 1020 may be the same as or different from, and may include some or all of the features of, keys 105 of FIG. 1 or keys 305 of FIG. 3, for example. Key 1020 may include an opaque keycap or a transparent keycap. Legend 1025 may be transparent if key 1020 is opaque and legend 1025 may be opaque if key 1020 is transparent, for example. Alternatively, both key 1020 and legend 1025 may be transparent, but may include different materials to provide a visual contrast in the perceived illumination.

Key 1020 may be selectively or variably illuminated using any suitable approach. For example, key 1020 may be selectively illuminated to aid a user in capitalizing letters. Upon receiving any suitable input, illumination source 1030 may emit light into light guide pipe 1000 and generally underneath key 1020. The light may diffuse upwardly from light guide pipe 1000 to illuminate key 1020, or legend 1025, or both. The light emitted by illumination source 1030 may be prevented from diffusing through undesired portions of light guide pipe 1000 using any suitable approach, such as slots 1050. Slots 1050*a*-1050*c* may be positioned to prevent the light emitted by illumination source 1030 from diffusing beyond the portion of light guide pipe 1000 underneath key 1020. Slots 1050 may also reflect light back into the area of light guide pipe 1000 bounded by the slots to enhance the particular illumination of key 1020. Because slots 1050 may diffuse the light from illumination source 1030 onto a reflector sheet, such as reflector sheet layer 125 of FIG. 1, the reflector sheet may reflect the diffused light back up through light guide pipe 1030 toward key 1020. In some embodiments, if slots 1050 are positioned such that they do not overlap with any unmasked portions within a mask layer above light guide pipe 1000, such as unmasked portions 145 within mask layer 140 of FIG. 1, then light reflected back through slots 1050 by a reflector sheet may be blocked from diffusing further through a mask layer.

In some embodiments, key 1020 may also be variably illuminated using any suitable approach. For example, light guide pipe 1000 may form a part of a keyboard within a device, such as a laptop, or may be coupled to another device, such as a desktop computer, with a display screen. The display screen may present an image that may request input from a user. As a result of the image being presented, a keyboard may receive a device input from the device instructing the keyboard to illuminate one or more keys to guide the user in providing input in response to the display screen (e.g., the keyboard may receive an instruction to illuminate the "CAPS LOCK" key). The keyboard may signal illumination source 1030 to emit light in response to the device input. The illumination may alert the user that the illuminated key may be useful in navigating the display screen. If the input from the device changes such that the "CAPS LOCK" key no longer needs to be illuminated, then the keyboard may receive an input from the device to instruct illumination source 1030 to stop emitting light, thereby indicating to the user that the "Caps Lock" key may no longer be needed to navigate the display screen.

Figure 11:
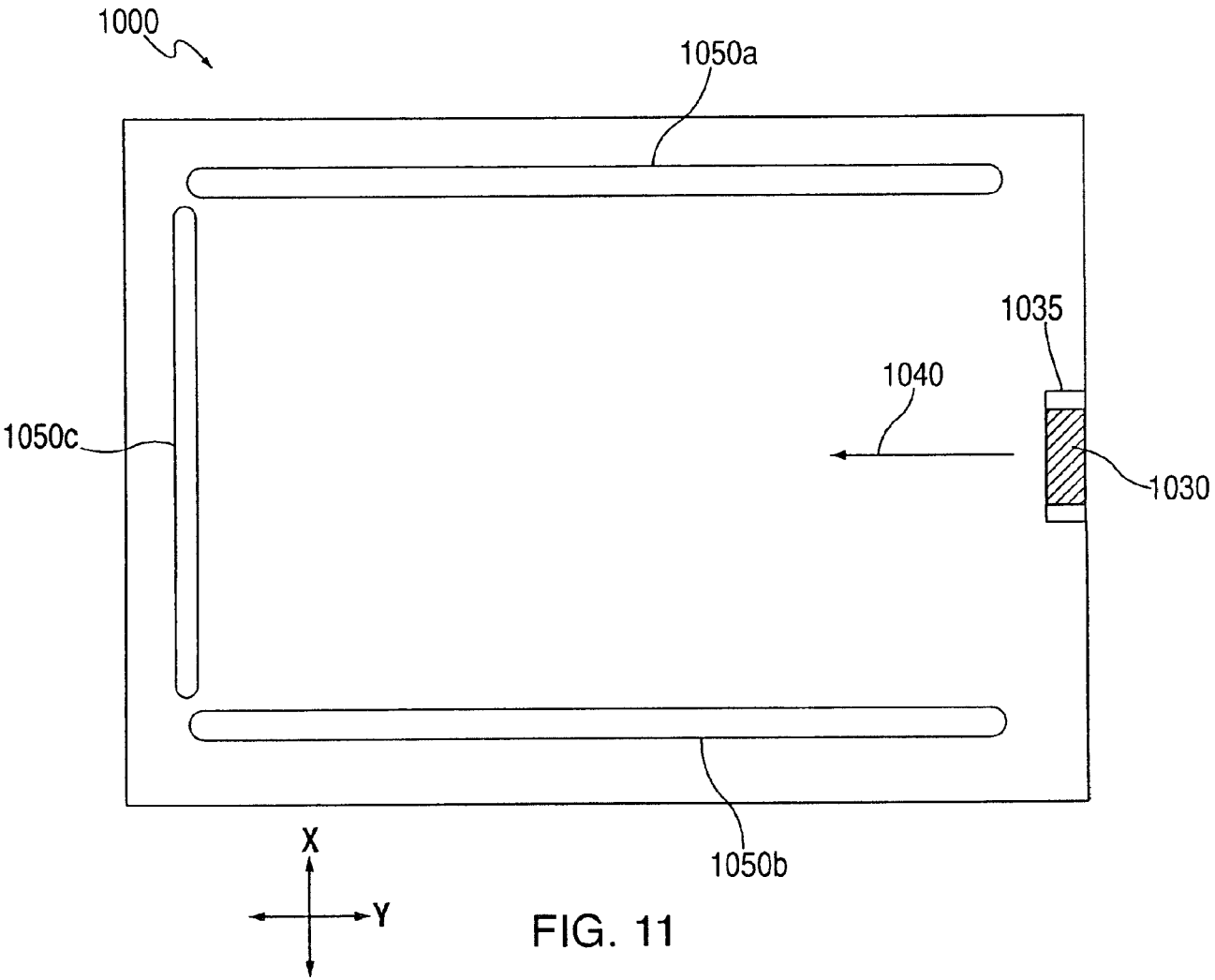
FIG. 11 shows a vertical cross-sectional view of the portion of the assembly of FIG. 10, but with a portion removed, in accordance with some embodiments of the invention.

FIG. 11 is a vertical cross-sectional view of the portion of the assembly of FIG. 10, but with key 1020 removed, in accordance with some embodiments of the invention. In response to any suitable input, illumination source 1030 may pass through hole 1035 and may emit light into light guide pipe 1000 generally in the direction of arrow 1040. Slots 1050 may channel away from light guide pipe 1000 any light emitted by illumination source 1030 that may have diffused toward slots 1050*a*-1050*c*.

Figure 12:
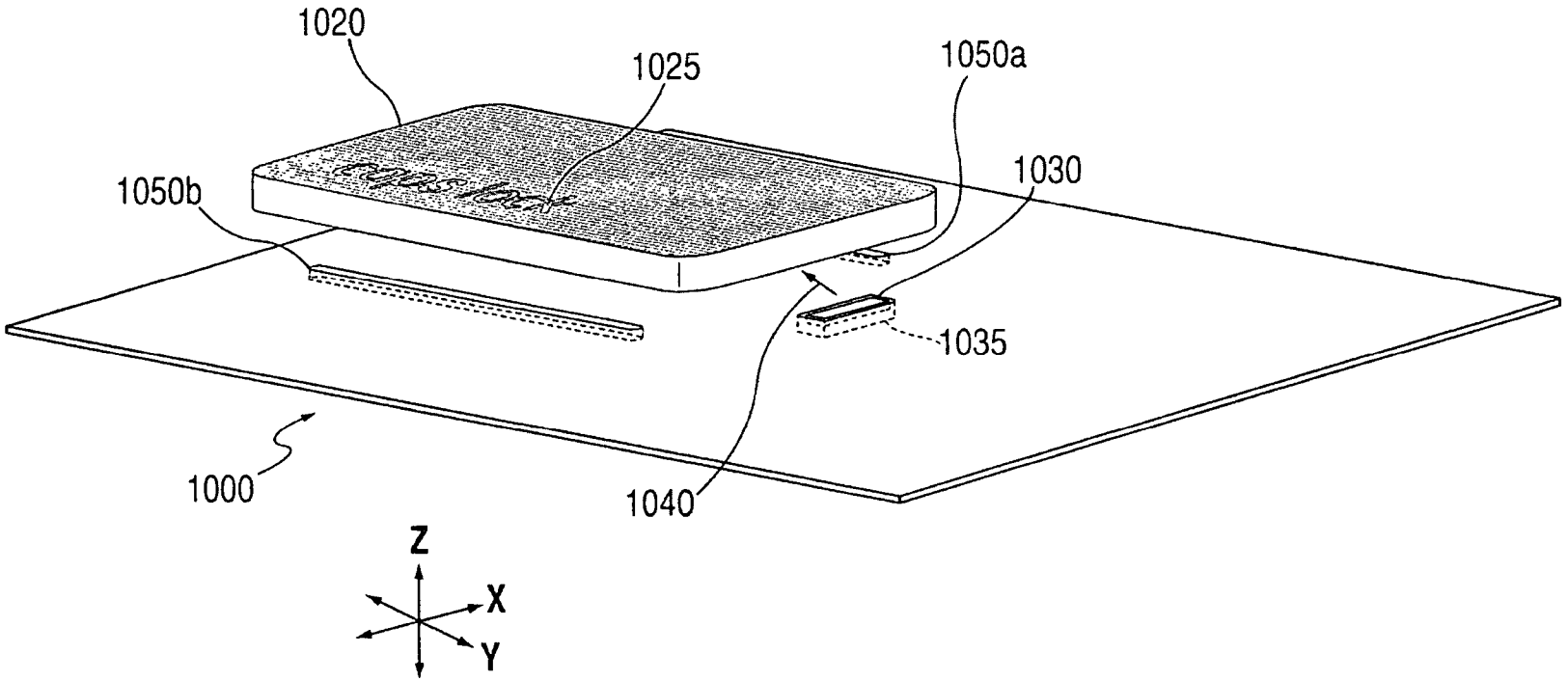
FIG. 12 shows a perspective view of the portion of the keyboard assembly of FIGS. 10-11 in accordance with some embodiments of the invention.

FIG. 12 is a perspective view of the portion of the assembly of FIG. 10 in accordance with some embodiments of the invention. Key 1020 may be positioned in any suitable layer above light guide pipe 1000. Light that may be emitted by illumination source 1030 in the direction of arrow 1040 may diffuse through light guide pipe 1000 and underneath key 1020. The light may diffuse upwardly away from light guide pipe 1000 and toward key 1020. Light guide pipe 1000 may also permit any other suitable illumination sources to emit light into light guide pipe 1000 for the purpose of generally illuminating key 1020.

Figure 13:
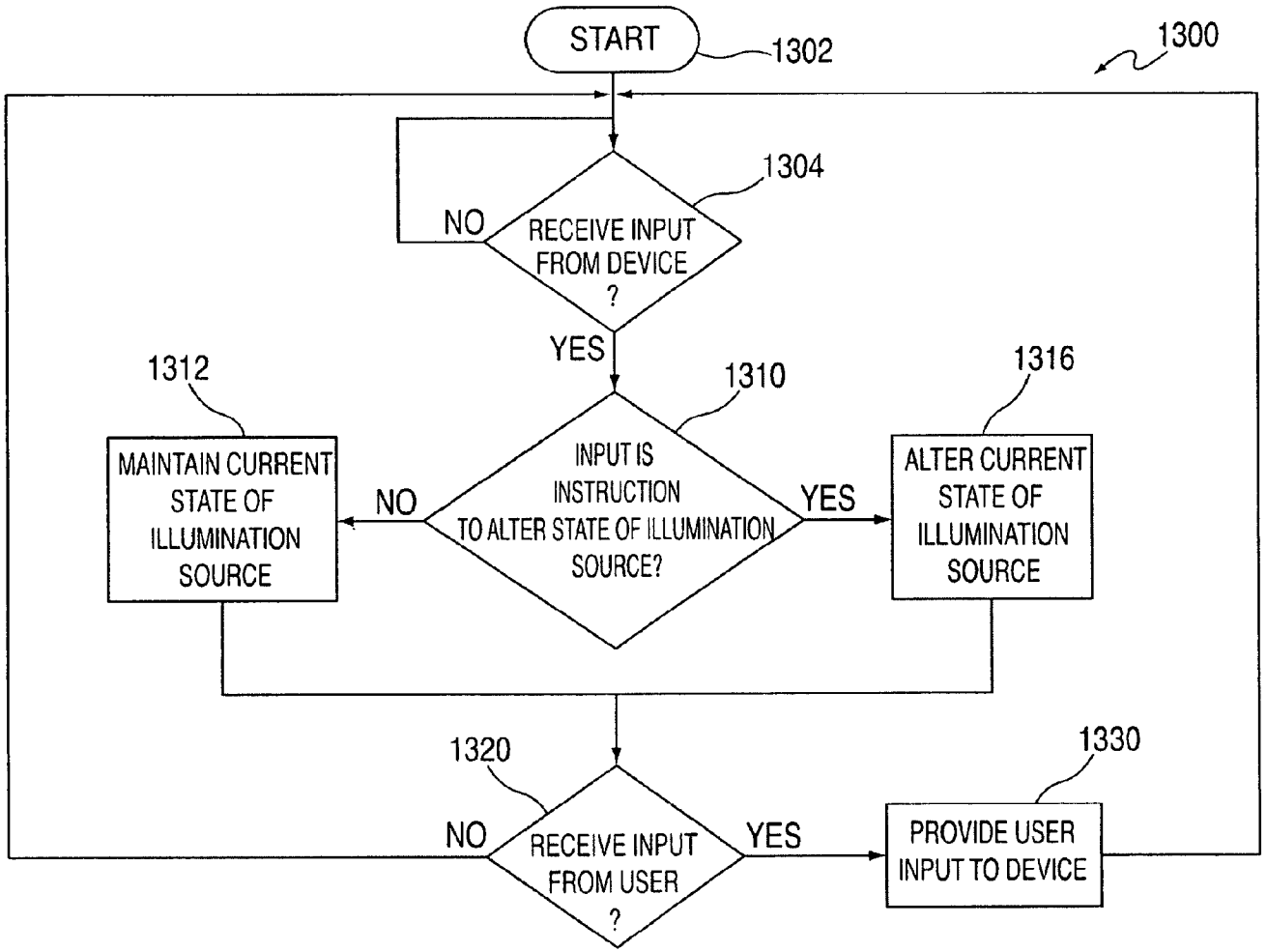
FIG. 13 shows a flowchart of an illustrative process for illuminating one or more keys of a keyboard assembly in accordance with some embodiments of the invention.

FIG. 13 shows a flowchart of an illustrative process for illuminating one or more keys of a keyboard assembly in accordance with some embodiments of the invention. Process 1300 may begin at step 1302. At step 1304, the keyboard may determine whether it has received an input from a device coupled to the keyboard. For example, the keyboard may be embedded within a laptop device that contains a display screen, or the keyboard may be coupled via a cable (e.g., cable 190 of FIG. 1) with a computer having a processor and a display screen. The device may send an input to the keyboard as a result of what is displayed on the display screen. If the keyboard has not received an input from the device, then process 1300 may return to step 1304 to continue sampling for an input from the device. If the keyboard has received an input, then process 1300 may move to step 1310.

At step 1310, the keyboard may determine whether the input received from the device is an instruction to alter the state of one or more illumination sources. For example, the display screen may display a menu of choices. To navigate the menu using the keyboard, the device may send an input to the keyboard that instructs the keyboard to alter the state of one or more illumination sources within the keyboard that would be beneficial to the user in navigating the menu. This input may instruct the keyboard to provide any suitable selective or variable illumination to the keyboard (e.g., using LED 720 or LED 749 of FIG. 7), to provide any suitable general illumination to the keyboard (e.g., using LEDs 602, 604, and 607 of FIG. 6), or to provide any suitable combination of general, selective, or variable illumination to the keyboard (e.g., using LEDs 502, 504, 506, 507, 509, 511 and 517 of FIG. 5) to illuminate the desired key or keys. The illumination that may result from the instruction may aid a user in navigating the menu. As another example, the keyboard may receive an input that instructs the keyboard to illuminate one or more currently dark illumination sources because the device has sensed that there is little or no light surrounding the keyboard, making it difficult for a user to use the keyboard.

If the input sent from the device is not an instruction to alter the current state of one or more illumination sources, then process 1300 may move to step 1312. At step 1312, the keyboard may maintain the current state of the illumination source or sources in the keyboard affected by the instruction and the keyboard may also maintain, by default, the current state of the illumination source or sources not affected by the instruction received from the device.

Process 1300 may then move to step 1320, where the keyboard may determine whether an input has been received from a user of the keyboard in response to maintaining the state of one or more illumination sources. For example, a user may provide an input to the keyboard by striking one or more keycaps on the keyboard (e.g., keycap 170 of key 105*a* of FIG. 2). If an input has not been received from a user, then process 1300 may return to step 1304 to continue sampling for an input from the device. If the keyboard receives an input from a user in response to maintaining the current state of one or more illumination sources, then process 1300 may move to step 1330. At step 1330, the keyboard may transmit the user's input to the device. The user's input may affect what the device displays next on the display screen, for example. As a result of an alteration in what is displayed on the screen, the device may send new input to the keyboard. Process 1300 may return to step 1304 to continue sampling for an input from the device.

If, at step 1310, the device has sent an instruction to alter the current state of one or more illumination sources (e.g., to illuminate or "turn on" one or more illumination sources that are currently unilluminated or "turned off," or vice versa), then process 1300 may move to step 1316. At step 1316, the keyboard may signal the appropriate illumination source or sources to alter its current state in response to the instruction received from the device. For example, the keyboard may have received an instruction from the device to begin illuminating the number pad, the "SPACEBAR" key, and/or the letters positioned on the left side of the keyboard (e.g., using LEDs 705, 715, and 720 of FIG. 7). Process 1300 may then move to step 1320, described above. Process 1300 may eventually return to step 1304, to continue sampling for an input from the device. The processes discussed above are intended to be illustrative and not limiting. Persons skilled in the art will appreciate that steps of the processes discussed herein may be omitted, modified, combined, and/or rearranged, and any additional steps can be performed without departing from the scope of the invention.

Figure 14:
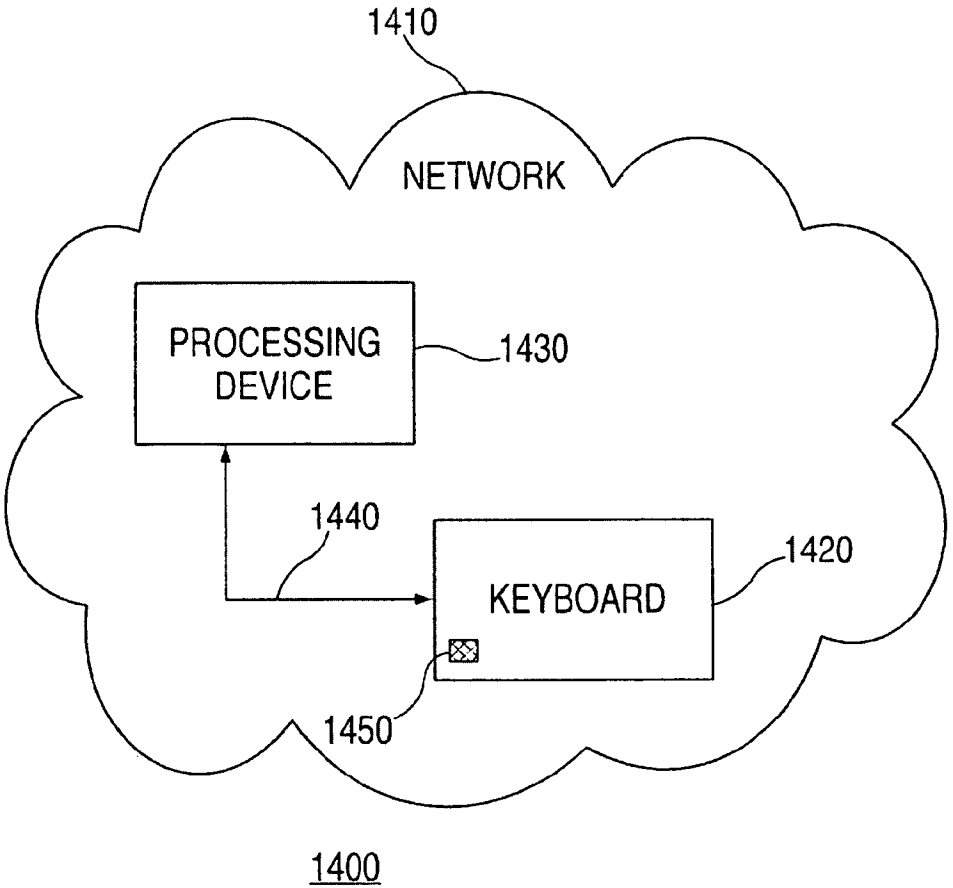
FIG. 14 shows a simplified schematic diagram of a system including a keyboard assembly in accordance with some embodiments of the invention.

FIG. 14 shows a simplified schematic diagram of a system including a keyboard assembly in accordance with some embodiments of the invention. System 1400 may include a processing device 1430 that can initiate an outgoing instruction and network 1410, which processing device 1430 may use to transmit instructions to other devices within network 1410. For example, system 1400 may include a keyboard 1420 that can receive instructions from processing device 1430. Although system 1400 may include several processing devices 1430 and keyboards 1420, only one of each is shown in FIG. 14 for the sake of simplicity and clarity. Keyboard 1420 may include one or more illumination sources 1450, only one of which is shown in FIG. 14 for simplicity and clarity. Illumination source 1450 may be the same as or different from, and may include some or all of the features of, other illumination sources (e.g., illumination sources 121 in FIG. 1 or illumination sources 321 in FIG. 3). Illumination source 1450 may be illuminated by keyboard 1420 in response to instructions received from processing device 1430.

Any suitable circuitry, device, system, or combination thereof (e.g., a wireless communications infrastructure including communications towers and telecommunications servers) operative to create a network may be used to create network 1410. Network 1410 may be capable of providing instructions using any suitable protocol. In some embodiments, network 1410 may support, for example, Wi-Fi (e.g., a 802.11 protocol), Bluetooth™, high frequency systems (e.g., 900 MHz, 2.4 GHz, and 5.6 GHz systems), infrared, other relatively localized wireless protocols, or any combination thereof. Processing device 1430 and keyboard 1420, when located in network 1410, may communicate over a path, such as path 1440. Both processing device 1430 and keyboard 1420 may be capable of sending an input to the other and receiving an input from the other.

Processing device 1430 may include any suitable device for transmitting and receiving inputs. For example, processing device 1430 may include a desktop computer, a laptop computer, a device capable of communicating wirelessly (with or without the aid of a wireless enabling accessory system) or via wired pathways (e.g., using traditional electrical wires), a pocket-sized personal computer such as an iPAQ Pocket PC available by Hewlett Packard Inc. of Palo Alto, Calif., a personal digital assistant ("PDA"), a personal e-mail or messaging device with audio and/or video capabilities (e.g., a Blackberry® or a Sidekick®), an iPod™ available by Apple Inc. of Cupertino, Calif., or an iPhone™ available by Apple Inc. The input may include any suitable form of instruction, including for example, voice instruction, data instruction, an instruction from a program installed in processing device 1430 (e.g., a spelling software tool), an instruction based upon an environmental condition (e.g., a signal related to the amount of ambient light measured in the vicinity of processing device 1430 or keyboard 1420), or combinations thereof.

While there have been described systems and methods for improving the keyboard illumination, it is to be understood that many changes may be made therein without departing from the spirit and scope of the present invention. It will also be understood that various directional and orientational terms such as "up" and "down," "left" and "right," "top" and "bottom," "side" and "edge" and "corner," "height" and "width" and "depth," "horizontal" and "vertical," and the like are used herein only for convenience, and that no fixed or absolute directional or orientational limitations are intended by the use of these words. For example, keyboards and illumination sources of this invention can have any desired orientation. If reoriented, different directional or orientational terms may need to be used in their description, but that will not alter their fundamental nature as within the scope of the invention. Those skilled in the art will appreciate that the invention can be practiced by other than the described embodiments, which are presented for purposes of illustration rather than of limitation, and the invention is limited only by the claims which follow.

What is claimed is:

1. A keyboard comprising:

a plurality of keys;

a plurality of source reflective surfaces; and a flexible circuitry layer positioned under the plurality of keys and comprising a first illumination source, wherein:

the first illumination source is configured to emit first light; and a first portion of the plurality of source reflective surfaces is positioned to at least partially form a first bounding region beneath at least a first key of the plurality of keys, wherein the first bounding region prevents the emitted first light from illuminating a second key of the plurality of keys, and wherein the second key is any key of the plurality of keys other than the at least a first key.

2. The keyboard of claim 1, further comprising a base layer positioned under the flexible circuitry layer, wherein the base layer comprises the plurality of source reflective surfaces.

3. The keyboard of claim 1, further comprising a second illumination source configured to emit second light, wherein a second portion of the plurality of source reflective surfaces is positioned to at least partially form a second bounding region beneath at least a third key of the plurality of keys, wherein the second bounding region prevents the emitted second light from illuminating a fourth key of the plurality of keys, and wherein the fourth key is any key of the plurality of keys other than the at least a third key.

4. The keyboard of claim 1, wherein the first portion of the plurality of source reflective surfaces comprises at least one of a mirror, a slot, a straight edge of the keyboard, a curved edge of the keyboard, and an edge of the keyboard with an applied reflective coating.

5. The keyboard of claim 2, further comprising a keyboard membrane layer positioned between the plurality of keys and the flexible circuitry layer, wherein the keyboard membrane layer comprises the second illumination source.

6. The keyboard of claim 1, further comprising a transparent layer positioned between the flexible circuitry layer and the plurality of keys, wherein the emitted first light travels within the transparent layer.

7. The keyboard of claim 6, wherein the transparent layer comprises the plurality of source reflective surfaces.

8. The keyboard of claim 6, wherein the transparent layer comprises at least one hole for passing the first illumination source at least partially through the transparent layer.

9. The keyboard of claim 6, wherein the first bounding region is at least partially formed by the transparent layer.

10. The keyboard of claim 1, wherein the first bounding region is at least partially formed by the first illumination source.

11. The keyboard of claim 1, wherein the at least a first key comprises a single key of the plurality of keys.

12. A keyboard comprising:

a plurality of keys; and a plurality of illumination sources, wherein a first illumination source of the plurality of illumination sources is configured to illuminate at least a first key of the plurality of keys but not a second key of the plurality of keys, and wherein a second illumination source of the plurality of illumination sources is configured to illuminate both the first key and the second key.

13. The keyboard of claim 12, further comprising a light guide pipe layer that extends underneath the plurality of keys, wherein:

the first illumination source extends into the light guide pipe layer for emitting first light along a first plane of the light guide pipe layer to illuminate at least the first key but not the second key;

the second illumination source extends into the light guide pipe layer for emitting second light along a second plane of the light guide pipe layer to illuminate both the first key and the second key; and the first plane is parallel to the second plane.

14. The keyboard of claim 13, further comprising:

a flexible circuitry layer comprising the first illumination source; and a base layer comprising the second illumination source, wherein the light guide pipe layer is positioned between the flexible circuitry layer and the base layer.

15. The keyboard of claim 12, further comprising a light guide pipe layer that extends underneath the plurality of keys, wherein:

the first illumination source extends into the light guide pipe layer through a top surface of the light guide pipe layer for emitting first light along the light guide pipe layer to illuminate at least the first key but not the second key; and the second illumination source extends into the light guide pipe layer through a bottom surface of the light guide pipe layer for emitting second light along the light guide pipe layer to illuminate both the first key and the second key.

16. The keyboard of claim 12, further comprising a transparent layer positioned between the plurality of keys and at least one of the first and second illumination sources, wherein the transparent layer comprises at least one hole for passing the first illumination source at least partially through the transparent layer.

17. The keyboard of claim 12, further comprising a transparent layer positioned between the plurality of keys and at least one of the first and second illumination sources, wherein the transparent layer comprises at least one slot for at least one of reflecting light emitted by the first illumination source and preventing the light emitted by the first illumination source from diffusing beyond the slot.

18. A keyboard comprising:

a plurality of keys;

a light guide pipe layer positioned under the plurality of keys; and a first illumination source positioned between the plurality of keys and the light guide pipe layer, wherein the first illumination source is configured to emit first light into the light guide pipe layer.

19. The keyboard of claim 18, wherein the first illumination source is configured to one of illuminate only a specific portion of the plurality of keys and generally illuminate the plurality of keys with the first light.

20. The keyboard of claim 18, further comprising at least one reflective surface to reflect the first light emitted by the first illumination source.

21. The keyboard of claim 20, further comprising a base layer, wherein the light guide pipe layer is positioned between the first illumination source and the base layer, and wherein the base layer comprises the at least one reflective surface.

22. The keyboard of claim 18, further comprising a second illumination source positioned under the light guide pipe layer, wherein the second illumination source is configured to emit second light into the light guide pipe layer.

23. The keyboard of claim 22, wherein the first illumination source is configured to illuminate only a specific portion of the plurality of keys with the first light, and wherein the second illumination source is configured to generally illuminate the plurality of keys with the second light.

24. The keyboard of claim 22, wherein the first illumination source is configured to generally illuminate the plurality of keys with the first light, and wherein the second illumination source is configured to illuminate only a specific portion of the plurality of keys with the second light.

25. The keyboard of claim 18, wherein the light guide pipe layer comprises at least one slot for at least one of reflecting the first light emitted by the first illumination source and preventing the first light emitted by the first illumination source from diffusing beyond the slot.

26. A keyboard comprising:

a plurality of keys;

at least a first source reflective surface; and a circuitry layer positioned under the plurality of keys, wherein the circuitry layer comprises at least a first illumination source, wherein the first illumination source emits first light in a first direction along a first plane parallel to the circuitry layer, and wherein the first source reflective surface reflects the first light in a second direction along the first plane.

27. The keyboard of claim 26, wherein the first illumination source emits second light in a third direction along a second plane perpendicular to the circuitry layer, and wherein the first source reflective surface reflects the second light in a fourth direction along a third plane parallel to the first plane.

* * * * *

UNITED STATES PATENT AND TRADEMARK OFFICE

CERTIFICATE OF CORRECTION

PATENT NO. : 8,785,796 B2
APPLICATION NO. : 13/678130
DATED : July 22, 2014
INVENTOR(S) : Chad A. Bronstein et al.

It is certified that error appears in the above-identified patent and that said Letters Patent is hereby corrected as shown below:

In the Claims

In Column 36, Claim 5, Line 43, delete "claim 2, further" and insert -- claim 3, further --, therefor.

Signed and Sealed this
Twenty-eighth Day of July, 2015

Michelle K. Lee

Michelle K. Lee
*Director of the United States Patent and Trademark Office*